US008821213B2

(12) United States Patent
Liu et al.

(10) Patent No.: US 8,821,213 B2
(45) Date of Patent: Sep. 2, 2014

(54) PIERCING AND/OR CUTTING DEVICES FOR ABRASIVE WATERJET SYSTEMS AND ASSOCIATED SYSTEMS AND METHODS

(75) Inventors: Peter H. -T. Liu, Bellevue, WA (US); Ernst H. Schubert, Snoqualmie Pass, WA (US)

(73) Assignee: OMAX Corporation, Kent, WA (US)

( * ) Notice: Subject to any disclaimer, the term of this patent is extended or adjusted under 35 U.S.C. 154(b) by 197 days.

(21) Appl. No.: 13/253,876

(22) Filed: Oct. 5, 2011

(65) Prior Publication Data

US 2012/0085211 A1 Apr. 12, 2012

Related U.S. Application Data

(60) Provisional application No. 61/390,946, filed on Oct. 7, 2010.

(51) Int. Cl.
*B24C 1/04* (2006.01)

(52) U.S. Cl.
USPC ..... 451/36; 451/2; 451/29

(58) Field of Classification Search
CPC ..... B24C 1/04; B24C 7/0007; B24C 7/0084
USPC ..... 451/36, 38–40, 102, 87, 90, 2; 269/43, 269/289 R
See application file for complete search history.

(56) References Cited

U.S. PATENT DOCUMENTS

| | | | | | |
|---|---|---|---|---|---|
| 1,081,071 | A | * | 12/1913 | Westland | 269/43 |
| 1,144,556 | A | * | 6/1915 | Lowe | 24/498 |
| 1,684,431 | A | * | 9/1928 | Behee, Jr. | 451/31 |
| 2,359,352 | A | * | 10/1944 | Bucknam et al. | 228/46 |
| 2,929,120 | A | * | 3/1960 | Brandt et al. | 164/17 |
| 2,985,050 | A | * | 5/1961 | Schwacha | 83/53 |
| 3,137,978 | A | * | 6/1964 | Incantalupo | 451/31 |
| 3,452,412 | A | | 7/1969 | Allman et al. | |
| 3,507,740 | A | * | 4/1970 | Gaspari | 428/42.2 |
| 3,593,459 | A | * | 7/1971 | Kulischenko | 451/75 |
| 3,708,936 | A | * | 1/1973 | Rogers | 451/29 |
| 3,769,753 | A | * | 11/1973 | Fleischer | 451/87 |

(Continued)

FOREIGN PATENT DOCUMENTS

GB 2198975 A * 6/1988 ..... B24C 5/02

OTHER PUBLICATIONS

International Search Report and Written Opinion for International Patent Application No. PCT/US11/54987, Applicant: Omax Corporation, mailing date: Mar. 2, 2012, 11 pages.

*Primary Examiner* — George Nguyen
(74) *Attorney, Agent, or Firm* — Perkins Coie LLP

(57) ABSTRACT

Embodiments of abrasive jet piercing and/or cutting devices are described herein. In some embodiments, a piercing device includes a holding or positioning device coupling a mixing tube to a secondary tube. The holding device has one or more passages extending to at least an intermediate portion of the piercing device. The one or more passages allow air to contact or mix with an abrasive waterjet as it travels through the piercing device. In some embodiments, a cutting device includes two plates configured so as to form a slot between the two plates. The cutting device can be placed directly on a workpiece, and an abrasive waterjet can be directed at the workpiece through the slot. An abrasive waterjet system utilizing the piercing and cutting devices disclosed herein can pierce holes and cut slots in materials that have reduced hole diameters and kerf widths, respectively.

30 Claims, 17 Drawing Sheets

(56) References Cited

U.S. PATENT DOCUMENTS

| | | | | | |
|---|---|---|---|---|---|
| 4,048,918 | A | * | 9/1977 | Peck | 101/114 |
| 4,164,183 | A | * | 8/1979 | Peck | 101/114 |
| 4,534,427 | A | * | 8/1985 | Wang et al. | 175/67 |
| 4,555,872 | A | * | 12/1985 | Yie | 451/40 |
| 4,674,239 | A | * | 6/1987 | Jodoin | 451/87 |
| 4,816,284 | A | * | 3/1989 | Magee | 427/11 |
| 4,817,342 | A | * | 4/1989 | Martin et al. | 451/90 |
| 4,951,429 | A | * | 8/1990 | Hashish et al. | 451/102 |
| 5,176,018 | A | * | 1/1993 | Thompson | 72/53 |
| 5,236,459 | A | * | 8/1993 | Koch et al. | 606/62 |
| 5,320,289 | A | * | 6/1994 | Hashish et al. | 239/434 |
| 5,330,167 | A | * | 7/1994 | Plumb | 269/43 |
| 5,335,459 | A | * | 8/1994 | Dale | 451/102 |
| 5,413,270 | A | * | 5/1995 | Lechervy et al. | 228/118 |
| 5,441,441 | A | * | 8/1995 | Cook et al. | 451/36 |
| 5,509,849 | A | * | 4/1996 | Spears, Jr. | 451/40 |
| 5,616,067 | A | * | 4/1997 | Goenka | 451/39 |
| 5,637,030 | A | * | 6/1997 | Chopra et al. | 451/39 |
| 5,649,694 | A | * | 7/1997 | Buck | 269/43 |
| 5,679,058 | A | * | 10/1997 | Rhoades | 451/40 |
| 5,704,824 | A | | 1/1998 | Hashish et al. | |
| 5,730,635 | A | * | 3/1998 | De Haas et al. | 445/24 |
| 5,759,086 | A | * | 6/1998 | Klingel | 451/28 |
| 5,800,231 | A | * | 9/1998 | De Haas et al. | 445/24 |
| 5,876,267 | A | * | 3/1999 | Kanda | 451/38 |
| 5,908,349 | A | * | 6/1999 | Warehime | 451/102 |
| 6,077,152 | A | * | 6/2000 | Warehime | 451/75 |
| 6,099,388 | A | * | 8/2000 | Fritsch et al. | 451/28 |
| 6,120,351 | A | * | 9/2000 | Zeng | 451/28 |
| 6,155,245 | A | * | 12/2000 | Zanzuri | 125/12 |
| 6,283,833 | B1 | * | 9/2001 | Pao et al. | 451/40 |
| 6,533,640 | B1 | * | 3/2003 | Nopwaskey et al. | 451/2 |
| 6,533,643 | B1 | * | 3/2003 | Feng | 451/29 |
| 6,752,685 | B2 | * | 6/2004 | Ulrich et al. | 451/2 |
| 7,040,959 | B1 | * | 5/2006 | Panuska et al. | 451/36 |
| 7,419,418 | B2 | * | 9/2008 | Alberts et al. | 451/2 |
| 7,485,027 | B2 | * | 2/2009 | Miller | 451/38 |
| 7,585,201 | B2 | * | 9/2009 | Kanai et al. | 451/2 |
| 7,815,490 | B2 | * | 10/2010 | Liu | 451/7 |
| 2003/0034122 | A1 | * | 2/2003 | Asai | 156/252 |
| 2003/0085295 | A1 | | 5/2003 | Dijkman et al. | |
| 2004/0107810 | A1 | * | 6/2004 | Sciulli et al. | 83/177 |
| 2005/0017091 | A1 | * | 1/2005 | Olsen et al. | 239/400 |
| 2007/0021039 | A1 | * | 1/2007 | Haslett | 451/32 |
| 2007/0131455 | A1 | * | 6/2007 | Blange | 175/67 |
| 2007/0155289 | A1 | * | 7/2007 | Miller | 451/38 |
| 2008/0060493 | A1 | * | 3/2008 | Liu | 83/53 |
| 2009/0318064 | A1 | | 12/2009 | Hashish | |
| 2010/0003894 | A1 | * | 1/2010 | Miller et al. | 451/5 |
| 2010/0269593 | A1 | * | 10/2010 | Moser et al. | 73/627 |
| 2011/0269382 | A1 | * | 11/2011 | Deleris | 451/102 |
| 2012/0085211 | A1 | * | 4/2012 | Liu et al. | 83/53 |
| 2012/0282845 | A1 | * | 11/2012 | Whang et al. | 451/38 |

* cited by examiner a. Hole pattern on Pyrex glass Wafer (46 columns by 46 rows)

b. Hole pattern machined with an R&D µAWJ nozzel a. Inlet (entry) surface b. Outlet (exit) surface a. Without a carbide stencil b. With a carbide stencil

PIERCING AND/OR CUTTING DEVICES FOR ABRASIVE WATERJET SYSTEMS AND ASSOCIATED SYSTEMS AND METHODS

CROSS-REFERENCE TO RELATED APPLICATION

This application claims priority to U.S. Provisional Patent Application No. 61/390,946, titled "PIERCING AND/OR CUTTING DEVICES FOR ABRASIVE WATERJET SYSTEMS AND ASSOCIATED SYSTEMS AND METHODS," filed Oct. 7, 2010, which is incorporated herein by reference in its entirety.

STATEMENT REGARDING FEDERALLY SPONSORED RESEARCH OR DEVELOPMENT

One or more inventions described herein were made with government support under an SBIR Phase I Grant #0944239 awarded by the National Science Foundation. The government may have certain rights in inventions disclosed herein.

TECHNICAL FIELD

This application is directed toward abrasive jet systems, and methods associated with abrasive jet systems.

BACKGROUND

Waterjet systems have a cutting head that produces a high-velocity waterjet that can be used to cut or pierce workpieces composed of a wide variety of materials. Abrasives can be added to the waterjet to improve the cutting or piercing power of the waterjet. Adding abrasives results in an abrasive-laden waterjet referred to as an "abrasive waterjet" or an "abrasive jet." The diameter of holes pierced and the kerf width of slots cut with the abrasive waterjet are proportional to the jet stream diameter. Reducing the hole diameter and kerf width can be achieved by reducing the size of the corresponding abrasive jet nozzle. Under certain circumstances, however, reducing the jet nozzle size may be difficult.

Certain materials, such as composite materials and brittle materials, may be difficult to pierce with an abrasive jet. An abrasive jet directed at a workpiece composed of such material strikes a surface of the workpiece and begins forming a cavity. As the cavity forms, a hydrostatic pressure may build within the cavity resulting from the conversion of the kinetic energy of high-speed water droplets into potential energy. This hydrostatic pressure may act upon sidewalls of the cavity and negatively impact the workpiece material. In the case of composite materials such as laminates, such hydrostatic pressure may cause composite layers to separate or delaminate from one another as the hydrostatic pressure exceeds the tensile strength of the weakest component of the materials, which is typically the composite binder. In the case of brittle materials such as glass, polymers, and ceramics, the hydrostatic pressure may cause the material to crack or fracture if the hydrostatic pressure acts upon intergranular cracks and/or micro fissures in the material or simply exceeds the tensile strength of the weakest material in the specimen being cut. Other aspects or effects of the abrasive jet other than the hydrostatic pressure may, in addition or as an alternative to the hydrostatic pressure, cause or result in damage to the material during abrasive jet piercing operations.

Conventional techniques for mitigating piercing damage to materials include pressure ramping and vacuum assist devices. Pressure ramping can involve using a reduced water pressure to form the waterjet and ensuring that abrasives are fully entrained in the waterjet before the hydrostatic pressure reaches a magnitude capable of causing damage to the material being pierced. A vacuum assist device can be used to draw abrasive into a mixing chamber of a waterjet cutting head prior to the arrival of water into the mixing chamber. Such a technique can prevent a water-only jet from striking the surface of the material.

DETAILED DESCRIPTION

Figure 1A:
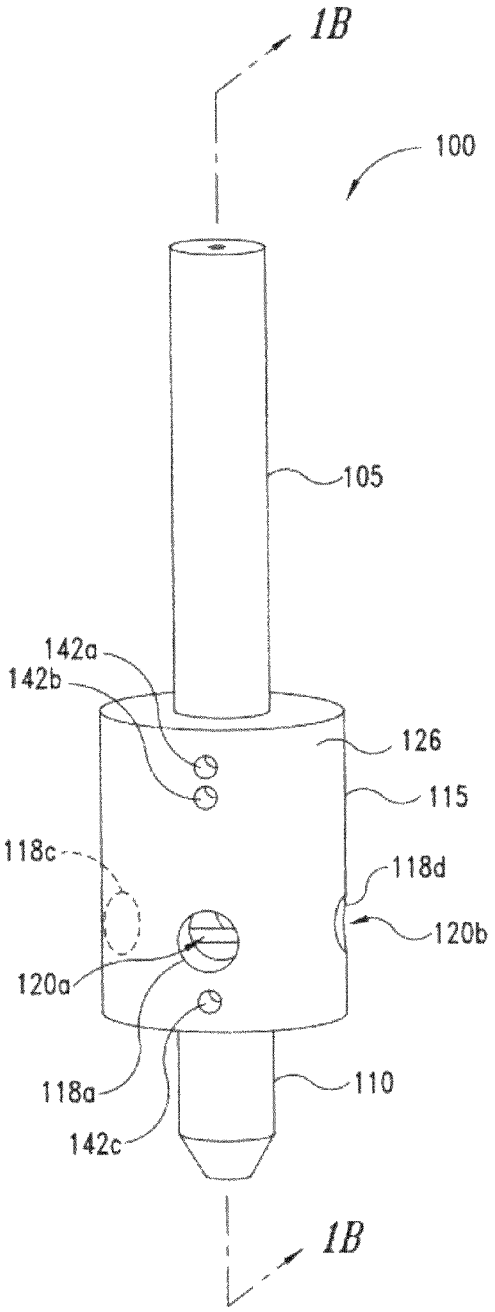
FIG. 1A is an isometric view of a piercing device configured in accordance with an embodiment of the disclosure.

This application describes various embodiments of piercing and/or cutting devices for use with abrasive jet systems that can perform piercing and/or cutting operations, such as operations to pierce composite and/or brittle materials and/or operations to cut thin slots in materials. As used herein, the term "piercing" may refer to an initial penetration or perforation of the target material by the abrasive jet. For example, piercing may include removing at least a portion of the target material with the abrasive jet to a predetermined depth and in a direction that is generally aligned with or generally parallel to the abrasive jet. More specifically, piercing may include forming an opening or hole in an initial outer portion or initial layers of the target material with the abrasive jet. Piercing may also mean that the abrasive jet penetrates completely through the workpiece or target material as a preparatory action prior to cutting a slot in the material.

The term "blind hole" may refer to when an abrasive waterjet is used to only partially pierce through a material to some depth that is less than the workpiece thickness. Moreover, the term "cutting" may refer to removal of at least a portion of the target material with the abrasive jet in a direction that is not generally aligned with or generally parallel to the abrasive jet. However, in some instances cutting can also include, after an initial piercing, continued material removal from a pierced opening with the abrasive jet in a direction that is generally aligned with or otherwise parallel to the abrasive jet. Once the material is pierced, cutting is generally performed by moving the head relative to the material perpendicular to the axis of the abrasive jet.

In addition, abrasive jet systems as disclosed herein can be used with a variety of suitable working fluids or liquids to form the fluid jet. More specifically, abrasive jet systems configured in accordance with embodiments of the present disclosure can include working fluids such as water, aqueous solutions, paraffins, oils (e.g., mineral oils, vegetable oil, palm oil, etc.), glycol, liquid nitrogen, and other suitable abrasive jet fluids. As such, the term "water jet" or "waterjet" as used herein may refer to a jet formed by any working fluid associated with the corresponding abrasive jet system, and is not limited exclusively to water or aqueous solutions. In addition, although several embodiments of the present disclosure may be described below with reference to water, other suitable working fluids can be used with any of the embodiments described herein. Moreover, abrasive jet systems as disclosed herein can also be used with a variety of pressurized gas sources and particulate or abrasive sources to affect or influence the abrasive jet. For example, abrasive jet systems configured in accordance with embodiments of the present disclosure can include pressurized gases such as air, nitrogen, oxygen, or other suitable abrasive jet pressurizing gases.

Certain details are set forth in the following description and in FIGS. 1A-12 to provide a thorough understanding of various embodiments of the technology. Other details describing well-known aspects of abrasive waterjet systems, however, are not set forth in the following disclosure to avoid unnecessarily obscuring the description of the various embodiments. Moreover, the present disclosure incorporates by reference in its entirety U.S. patent application Ser. No. 13/165,009, titled "SYSTEMS FOR ABRASIVE JET PIERCING AND ASSOCIATED METHODS," filed Jun. 21, 2011.

Many of the details, dimensions, angles and other features shown in the Figures are merely illustrative of particular embodiments. Accordingly, other embodiments can have other details, dimensions, angles and features. In addition, further embodiments can be practiced without several of the details described below.

In the Figures, identical reference numbers identify identical, or at least generally similar, elements. To facilitate the discussion of any particular element, the most significant digit or digits of any reference number refer to the Figure in which that element is first introduced. For example, element 100 is first introduced and discussed with reference to FIG. 1A.

Piercing Devices for Abrasive Waterjet Systems

Figure 1B:
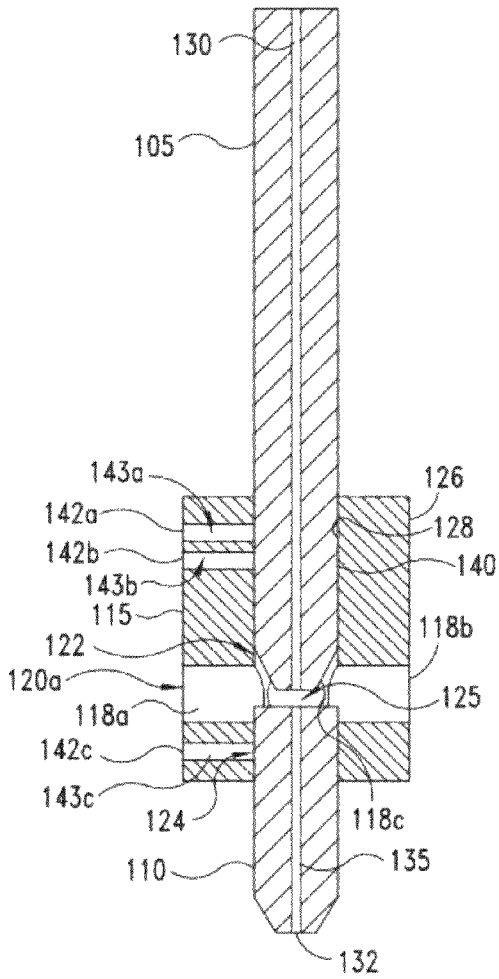
FIG. 1B is a cross-sectional side view taken substantially along line 1B-1B in FIG. 1A.

FIG. 1A is an isometric view of a piercing device 100 of a nozzle assembly configured in accordance with an embodiment of the disclosure. FIG. 1B is a cross-sectional side view taken substantially along line 1B-1B of FIG. 1A. Referring to FIGS. 1A and 1B together, the piercing device 100 includes a mixing tube 105, a secondary tube 110, and a holding or positioning device 115 (e.g., a sleeve, collet, etc.) coupled to both the mixing tube 105 and the secondary tube 110. The mixing tube 105 is generally cylindrical and has a first axial passage 130 with a first inside diameter extending therethrough. The secondary tube 110 is also generally cylindrical and has a second axial passage 135 with a second inside diameter, and an exit 132. The second inside diameter can be the same size, larger than, or smaller than the first inside diameter. The axial passages 130 and 135 are concentrically aligned so that an abrasive waterjet can travel through the axial passage 130 and then the axial passage 135. As can be seen in FIG. 1A, the piercing device 100 can be configured such that there is a gap 125, at an intermediate portion of the piercing device 100, between a first end portion 122 of the mixing tube 105 and a second end portion 124 of the secondary tube 110.

Figure 1C:
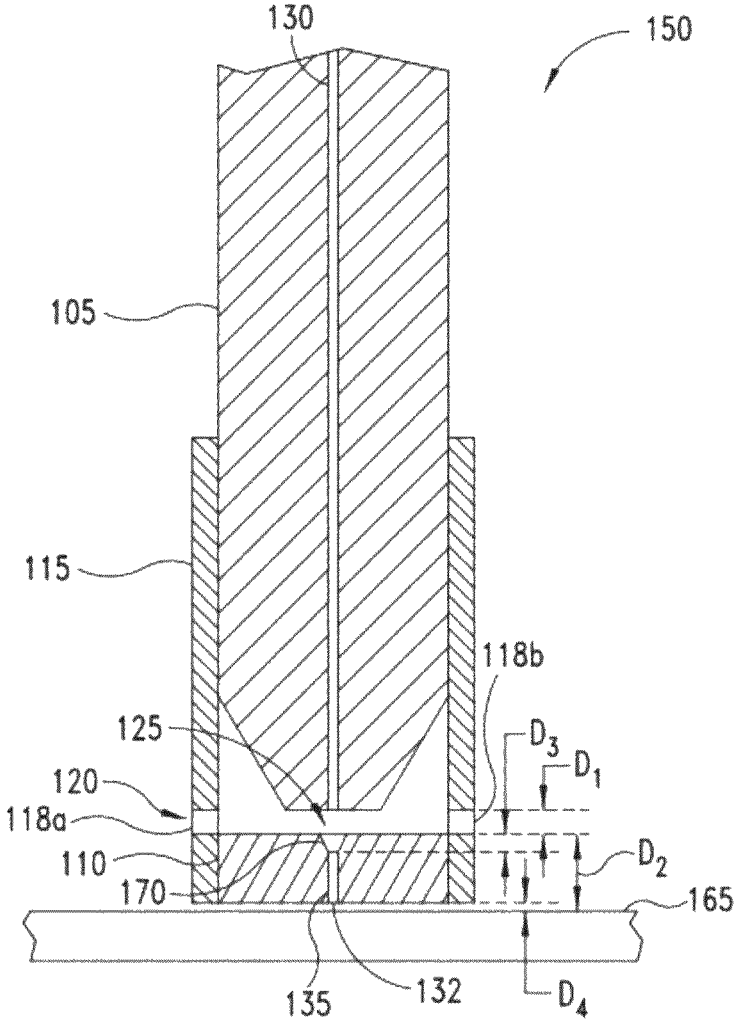
FIG. 1C is a cross-sectional side view of a piercing device configured in accordance with another embodiment of the disclosure.

In some embodiments, the secondary tube 110 is a portion of a mixing tube. In other embodiments, the secondary tube 110 can include an orifice (made of, e.g., synthetic diamond, sapphire, ruby, etc.) and is oriented so that the orifice inlet cone faces upstream (for example, as illustrated in FIG. 1C). In certain embodiments, each of the mixing tube 105 and the secondary tube 110 can be made of any suitable material known in the art (e.g., tungsten carbide and/or binderless composite carbide materials, high-grade carbides, chemical vapor deposition (CVD) diamond material, etc.).

In the illustrated embodiment, the holding device 115 is also generally cylindrical and has an axial passage 140 with an inner diameter that is generally the same as the outer diameters of the mixing tube 105 and the secondary tube 110. The holding device 115 has three openings 142 (identified individually as openings 142*a*, 142*b*, and 142*c*) formed in an outer surface 126. The openings 142 open to corresponding passages (143*a*, 143*b*, and 143) extending from the outer surface 126 of the holding device 115 to an inner surface 128 of the holding device 115. In one embodiment, the passages 143 can include female threads that enable the holding device 115 to be coupled to the mixing tube 105 and the secondary tube 110 by, e.g., threaded fasteners (not shown).

The holding device 115 also has four openings 118 (identified individually as openings 118*a-d*) in the outer surface 126. A first passage 120*a* extends from the first opening 118*a* to the gap 125 and then to the second opening 118*b*. A second passage 120*b* extends transverse to the first passage 120*a* from the third opening 118*c* to the gap 125 and then to the fourth opening 118*d*. The holding device 115 can be made of any suitable material (e.g., aluminum, stainless steel, etc.).

The piercing device 100 is configured to be coupled to an abrasive waterjet system to form a cutting head (alternatively referred to as a nozzle assembly) with other components of the abrasive waterjet system. An example of an abrasive waterjet system with which the piercing device 100 can be used is described with reference to, for example, a system described below and illustrated in FIG. 11.

In operation, pressurized water passes through an orifice (not shown in FIG. 1A) of the cutting head of the abrasive waterjet system to form a waterjet. Abrasives conveyed to the cutting head mix with the waterjet in a mixing region (also not shown in FIG. 1A) downstream of the orifice to form an abrasive waterjet (alternatively referred to as an abrasive jet). The abrasive waterjet travels through the axial passage 130 before exiting the mixing tube 105. The abrasive waterjet then passes across the gap 125 and enters the axial passage 135 of the secondary tube 110. The abrasive waterjet travels through the axial passage 135 and through the exit 132 to, for example, impact a workpiece. The passages 120 allow air to come into contact with the abrasive waterjet proximate to or at the gap 125. Such contact occurs after the abrasive waterjet has been formed in the mixing region but before the abrasive waterjet exits the secondary tube 135. Stated another way, the passages 120, which are downstream of any mixing region but upstream of the exit 132, can provide air from the openings 118 to the abrasive waterjet. The gap 125 and passages 120 also provide an escape passage for water droplets and abrasives with large divergence angles.

One advantage of the piercing device 100 is that it may allow piercing of certain materials, such as composite materials and brittle materials, without pressure ramping or the use of vacuum assist devices. Instead, a mixing tube 105 may be used in conjunction with a secondary tube 110 and holding device 115 to pierce such materials without the use of any additional techniques or hardware typically employed to facilitate piercing operations. The introduction of air into the abrasive waterjet may degrade the quality of the abrasive waterjet formed by the piercing device 100. Such degradation in the abrasive waterjet may be visible or may not be visible. Accordingly, the piercing device 100 may slightly reduce the erosive power of the abrasive jet exiting the piercing device 100, but without degrading the piercing capabilities of the abrasive waterjet to such an extent that materials cannot be pierced.

Without wishing to be bound by any particular theory, it is believed that the degraded abrasive waterjet may alleviate a hydrostatic pressure buildup in a cavity formed by the abrasive waterjet and thereby allow piercing of composite or brittle materials that otherwise may not be satisfactorily pierced using conventional waterjet piercing techniques. Alternatively, the degraded abrasive waterjet may not alleviate the hydrostatic pressure buildup in the cavity, or the degraded abrasive waterjet may cause other effects, and any combination of these effects may result in the piercing of composite or brittle materials without damage to such materials.

When the mixing tube 105 is used for certain piercing operations, it has been found that the diameter of an abrasive waterjet-pierced hole can be approximately 1.5 to approximately 2 times that of the inside diameter of the axial passage 130. For example, the diameter of a hole pierced with a mixing tube 105 having a 0.015 inch (0.38 mm) inside diameter is typically about 0.03 inch (0.76 mm). As previously noted, in some embodiments, the inside diameter of the axial passage 135 of the secondary tube 110 is smaller than the inside diameter of the axial passage 130 of the mixing tube 105. When the axial passage 135 has an inside diameter of about 0.008 inch (0.2 mm) and the axial passage 130 has an inside diameter of about 0.015 inch (0.38 mm), the resulting diameter of the pierced hole can be about 0.016 inch (0.4 mm). Accordingly, one advantage of using the piercing device 100 in such embodiments is a reduction in the size of pierced holes.

To obtain a hole having such an inside diameter without using a secondary tube 110 would require using a mixing tube 105 having with an axial passage 130 having an inside diameter of 0.008 inch (0.2 mm). However, such a configuration may reduce the erosive power of the abrasive waterjet due to large drag forces exerted on the abrasive waterjet flowing through the 0.008 inch (0.2 mm) inside diameter of the axial passage 130. In order to avoid nozzle clogging due to potential bridging inside the axial passage 130 of the mixing tube 105, an abrasive that is finer (e.g., an abrasive that is smaller than 220 mesh) than what is typically used in a mixing tube 105 having a 0.015 inch (0.38 mm) inside diameter can be used. However, one drawback of using finer abrasives can be that such abrasives do not flow well using gravity feed systems. A piercing device 100 having a secondary tube 110 with an axial passage 135 having an inside diameter of 0.008 inch (0.2 mm) can use the same size abrasive that is typically used with a mixing tube 105 having an axial passage 130 with an inside diameter of 0.015 inch (0.38 mm). Accordingly, another advantage of using a piercing device 100 configured according to some embodiments is the ability to use a larger abrasive (e.g., garnet) yet still pierce the same size holes as smaller configurations.

Moreover, in some embodiments, a smaller inside diameter of the axial passage 135 of the secondary tube 110 allows only the center portion of the abrasive waterjet to pass through the axial passage 135 and thereby impact the workpiece. This can allow for a reduction in the kerf width of features or smaller diameter of holes machined on the workpiece. Accordingly, another advantage of using a piercing device 100 configured according to some embodiments is a reduction in kerf width.

FIG. 1C is a cross-sectional side view of a piercing device 150 configured in accordance with another embodiment of the disclosure. The piercing device 150 can be generally similar to that of FIGS. 1A and 1B, but in the embodiment illustrated in FIG. 1C the secondary tube 110 has a conical inlet 170 to the second axial passage 135. The conical inlet 170 can facilitate a smooth transition of the abrasive water jet from the mixing tube 105 to the secondary tube 110. The holding device 115 has two openings 118 (shown individually as openings 118*a* and 118*b*) and a passage 120 that extends entirely through the holding device 115 between the two openings 118. The holding device 115 can also have several openings and corresponding passages (not shown in FIG. 1C) into which fasteners can be inserted to secure the holding device 115 to the mixing tube 105 or the secondary tube 110.

In some embodiments, the inside diameter of the axial passage 130 of the mixing tube 105 can be about 0.015 inch (0.38 mm), and the inside diameter of the axial passage 135 of the secondary tube 110 can be about 0.008 inch (0.2 mm). The distance $D_1$ between the mixing tube 105 and the secondary tube 110 can be about 0.06 inch (1.5 mm). The secondary tube 110 can have a height $D_2$ of about 0.2 inch (5.1 mm). The conical inlet 170 can have a height $D_3$ of about 0.05 inch (1.27 mm). The standoff distance $D_4$ between the end of the secondary tube 110 and the workpiece 165 can be between about 0.01 inch (0.25 mm) and 0.02 inch (0.51 mm) for one or more reasons, such as to reduce spread of the abrasive waterjet before the abrasive waterjet impacts the workpiece 165.

Figure 2A:
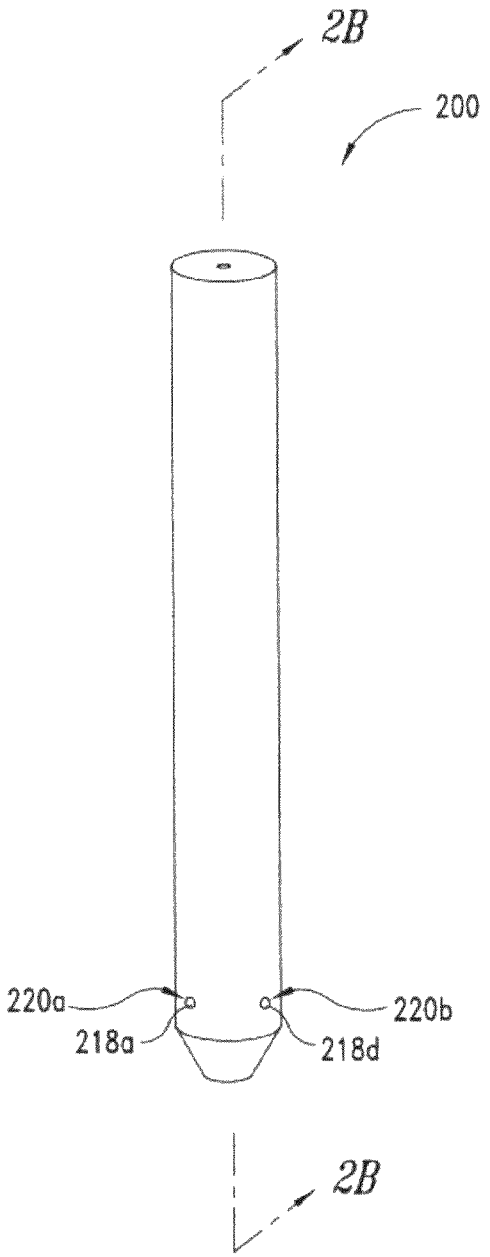
FIG. 2A is an isometric view of a piercing device configured in accordance with a further embodiment of the disclosure.
Figure 2B:
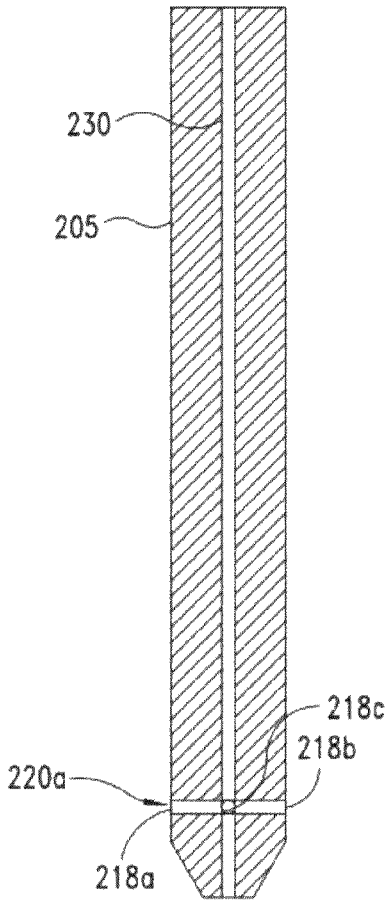
FIG. 2B is a cross-sectional side view taken substantially along line 2B-2B in FIG. 2A.

FIG. 2A is an isometric view of a piercing device 200 configured in accordance with another embodiment of the disclosure. FIG. 2B is a cross-sectional side view taken substantially along line 2B-2B of FIG. 2A. Referring to FIGS. 2A and 2B together, the piercing device 200 includes a mixing tube 205 that is generally cylindrical and has an axial passage 230 that has an inside diameter. The mixing tube 205 also four openings 218 (identified individually as openings 218*a-d*) in the outer surface of the mixing tube 205. A first passage 220*a* extends from the first opening 218*a* to the second opening 218*b*, and a second passage 220*b* transverse to the first passage 220*a* extends from the third opening 218*c* to the fourth opening 218*d*. Accordingly, there are four points of ingress for air to enter the passages 220 and thereby come into contact with (and potentially affect) the abrasive waterjet passing through the axial passage 230.

Figure 3A:
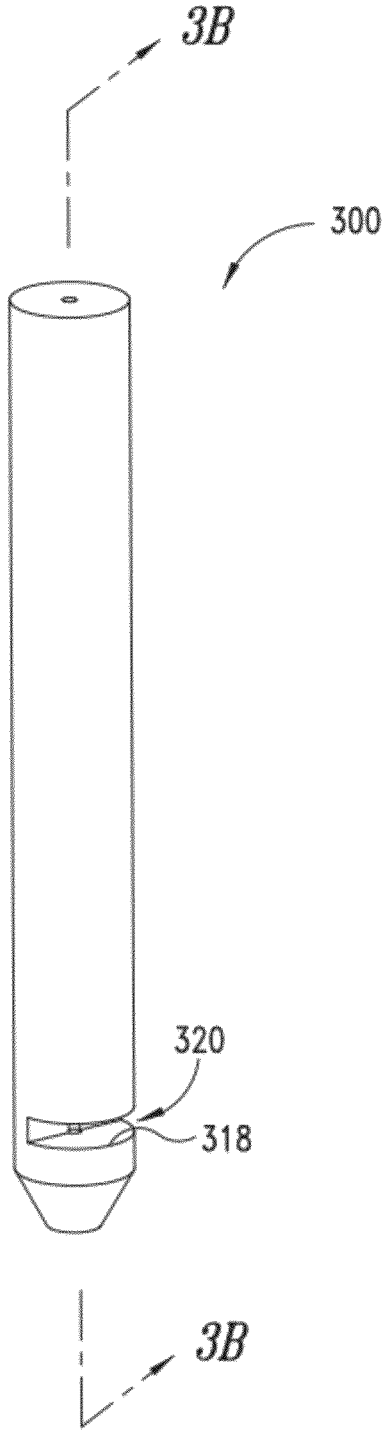
FIG. 3A is an isometric view of a piercing device configured in accordance with yet another embodiment of the disclosure.
Figure 3B:
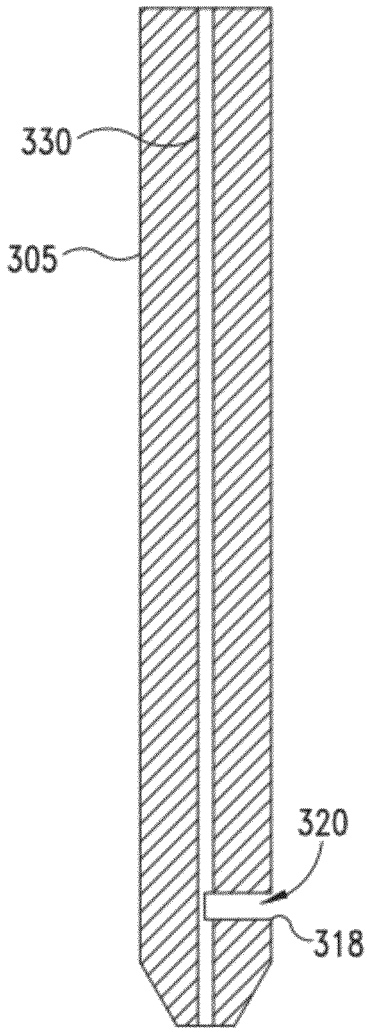
FIG. 3B is a cross-sectional side view taken substantially along line 3B-3B in FIG. 3A.

FIG. 3A is an isometric view of a piercing device 300 configured in accordance with another embodiment of the disclosure. FIG. 3B is a cross-sectional side view taken substantially along line 3B-3B of FIG. 3A. Referring to FIGS. 3A and 3B together, the piercing device 300 includes a mixing tube 305 that is generally cylindrical and has an axial passage 330 that has an inside diameter. There is an opening 318 in the outer surface of the mixing tube 305 that opens to a passage 320 having a semicircular disc shape. The passage 320 extends from the opening 318 to the axial passage 330. The passage 320 allows air entering through the opening 318 to contact the abrasive waterjet traveling through the axial passage 330.

Figure 4A:
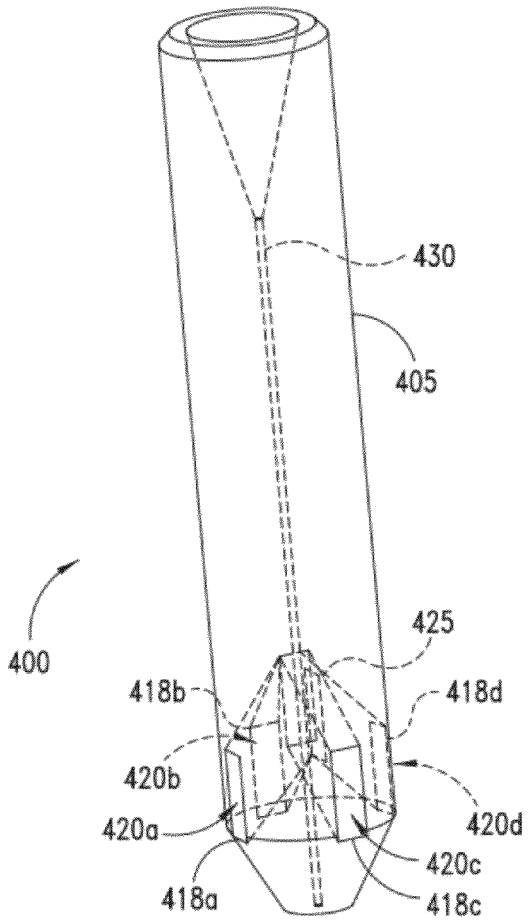
FIGS. 4A and 4B are isometric views of piercing devices configured in accordance with other embodiments of the disclosure.
Figure 4B:
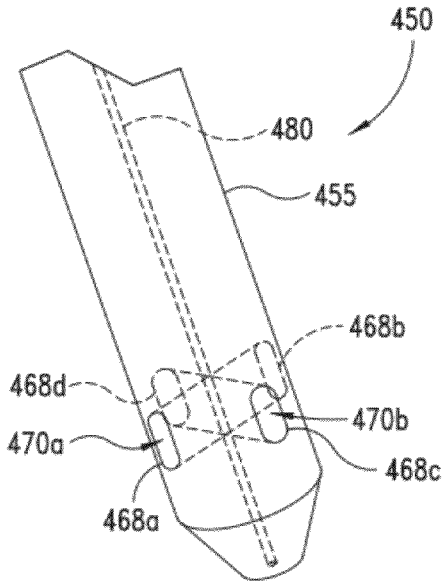

FIGS. 4A and 4B are isometric views of piercing devices 400 and 450, respectively, configured in accordance with other embodiments of the disclosure. The piercing device 400 illustrated in FIG. 4A includes a mixing tube 405 that is generally cylindrical and has an axial passage 430 that has an inside diameter. The mixing tube 405 has four openings 418 (shown individually as openings 418*a-d*) in the outer surface of the mixing tube 405. There are also four passages 420 (shown individually as passages 420*a-d*) extending from corresponding openings 418 to the axial passage 430. The passages 420 are biased (i.e., not perpendicular) to the outer surface of the mixing tube 405. The openings 418 of the passages 420 are generally rectangular in shape.

The piercing device 450 illustrated in FIG. 4B includes a mixing tube 455 that is generally cylindrical and has an axial passage 480 that has an inside diameter. The mixing tube 455 has four openings 468 (shown individually as openings 468*a-d*) in the outer surface of the mixing tube 455. A first passage 470*a* extends from opening 468*a* to 468*b*, and a second passage 470*b* transverse to the first passage 470*a* extends from opening 468*c* to opening 468*d*. The openings 468 are generally oval in shape. The openings 418/468 can have other shapes, such as circular, elliptical, square, or any other polygonal shape. The openings 418/468 can have mixed configurations (e.g., one opening having a generally rectangular shape while another opening has a generally oval shape, etc.). The passages 420/470 can taper from the openings 418/468 to the axial passages 430/480 or have a reverse taper from the openings 418/468 to the axial passages 430/480. The passages 420/470 allow air entering through the openings 420/470 to contact the abrasive waterjet traveling through the axial passages 430/480.

Figure 5A:
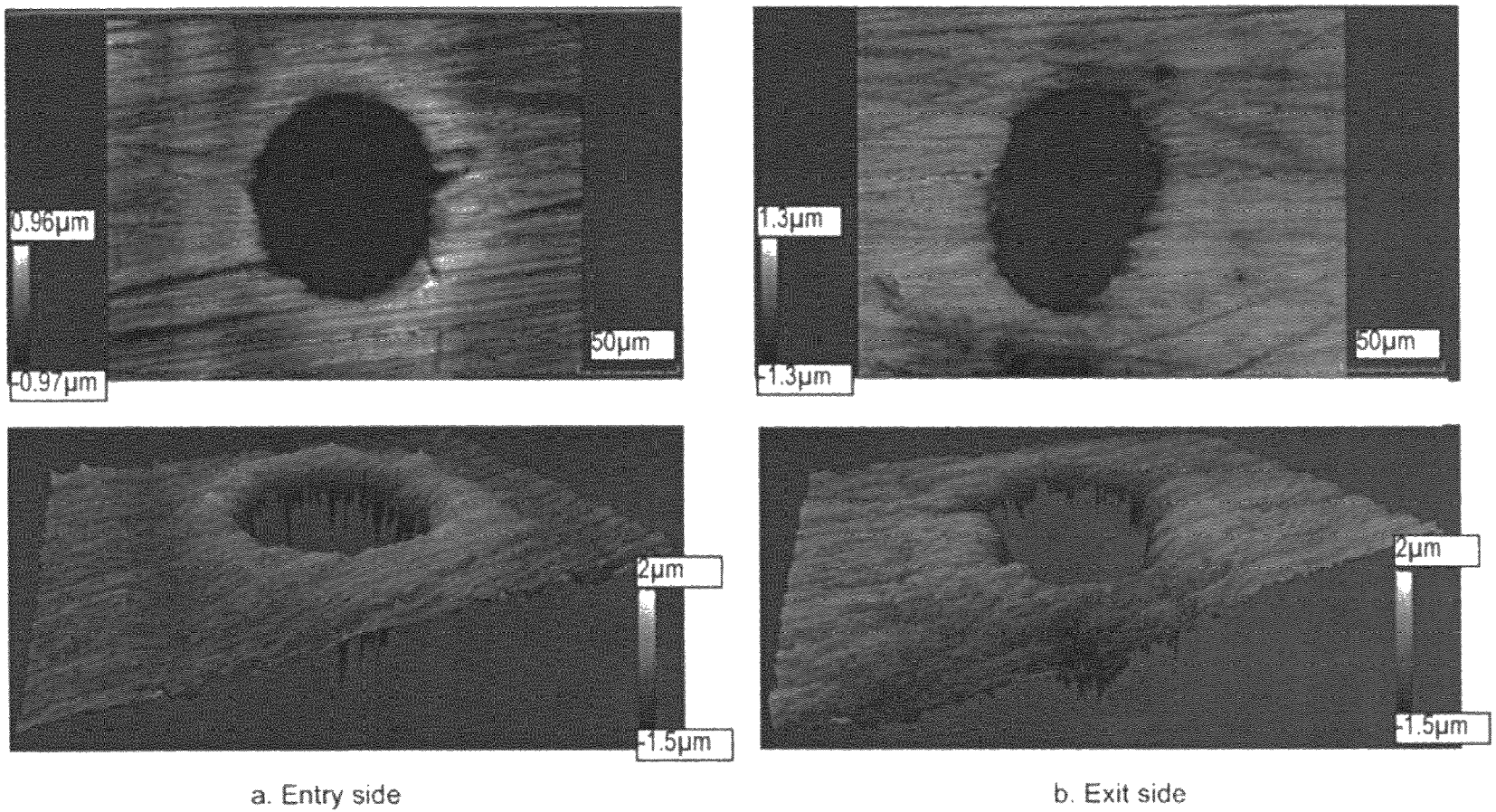
FIGS. 5A-5E are graphical depictions of holes pierced in various materials with embodiments of cutting and/or piercing devices configured in accordance with the present disclosure in comparison with conventional hole piercing techniques.

FIG. 5A provides various depictions of portions of a hole pierced in a thin metal shim along with corresponding three-dimensional micrographs of the hole. The hole was pierced using a piercing device configured in accordance with an embodiment of the disclosure. The piercing device had a secondary tube, made of a diamond orifice, having an axial passage that is about 0.001 inch (0.025 mm). The diameter of the hole is about 0.1 mm, which is about 4 times that of the diameter of the axial passage of the secondary tube.

Figure 5B:
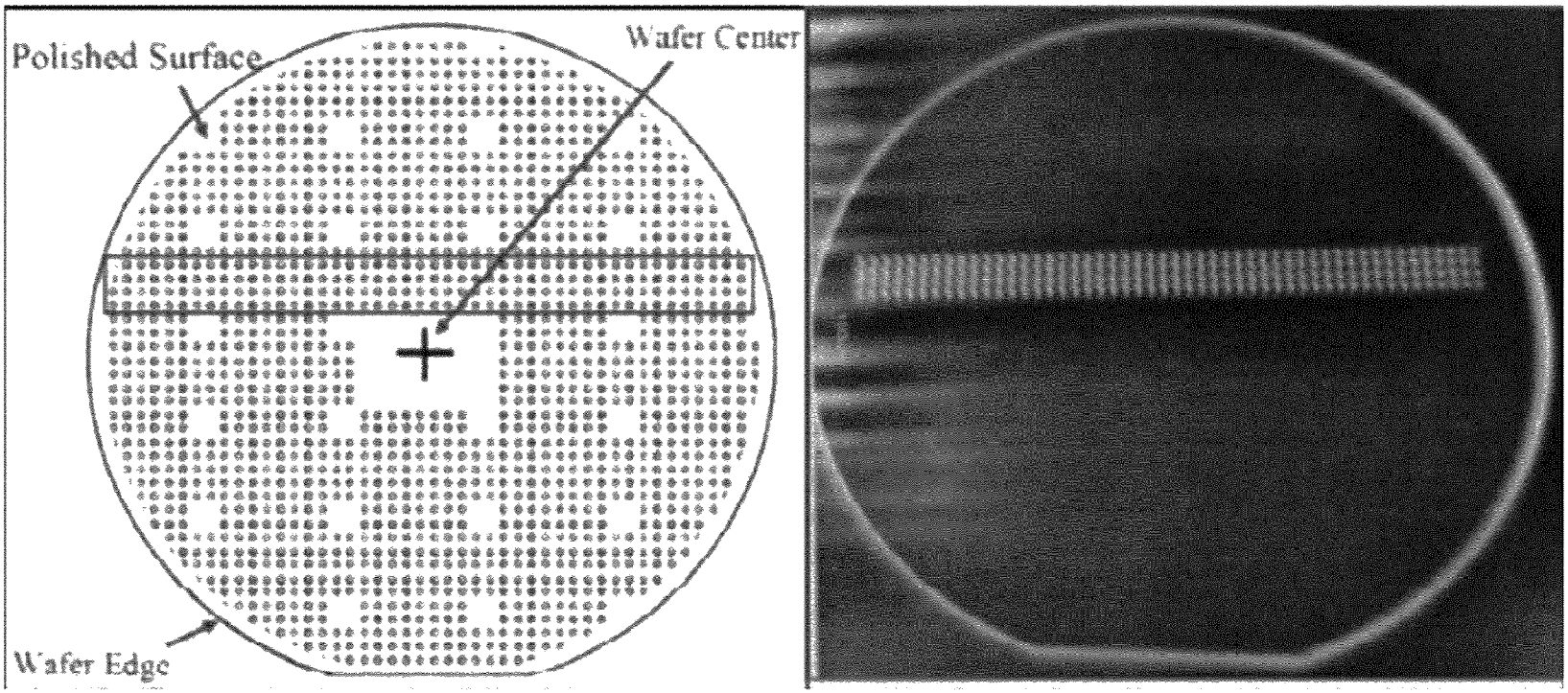
Figure 5C:
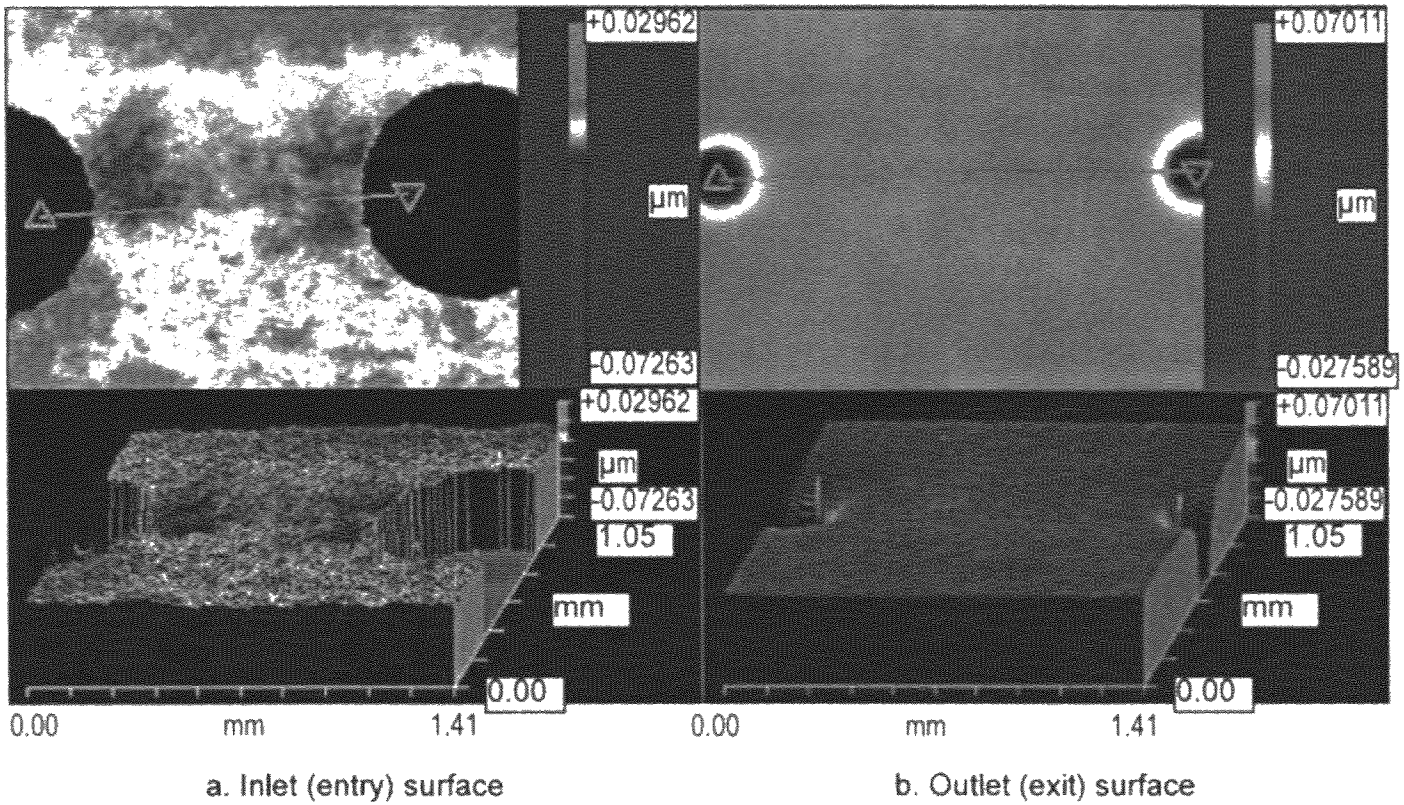

FIG. 5B depicts (a.) a desired hole pattern on a Pyrex glass wafer and (b.) a hole pattern made using a piercing device configured in accordance with an embodiment of the disclosure. FIG. 5C depicts Wyko results showing roughness profiles of the inlet (entry) and outlet (exit) surface.

According to additional features of embodiments configured in accordance with the disclosure, methods of processing a workpiece can include initially piercing the workpiece to form a blind hole or opening with a water or liquid based working fluid abrasive jet (e.g., an abrasive waterjet), followed by extending the hole completely through the workpiece with a secondary gas based working fluid abrasive jet (e.g., an abrasive jet). More specifically, an initial abrasive waterjet can pierce the workpiece to a first or intermediate depth extending from a first side of the workpiece. The intermediate depth can be less than a thickness of the workpiece, such as, for example from about 50-95% of the workpiece thickness. In other embodiments, however, the intermediate depth can be from about 75-95% of the workpiece thickness. In further embodiments, the intermediate depth can be from about 90-95% of the workpiece thickness. The secondary or follow-up abrasive jet can then extend or otherwise form the hole completely through the workpiece from the first side of the workpiece. In addition to forming the through hole, the secondary abrasive jet can also change a cross-sectional dimension of the hole that was initially formed by the abrasive waterjet. More specifically, the initial waterjet piercing may form a diameter or other cross-sectional dimension of the hole, and the secondary abrasive jet may be used to enlarge, trim, or otherwise alter the diameter or other cross-sectional dimension of the hole. In still further embodiments of the disclosure, the initial abrasive waterjet and/or the secondary abrasive jet can be used with the piercing and/or cutting devices as disclosed herein.

Figure 5D:
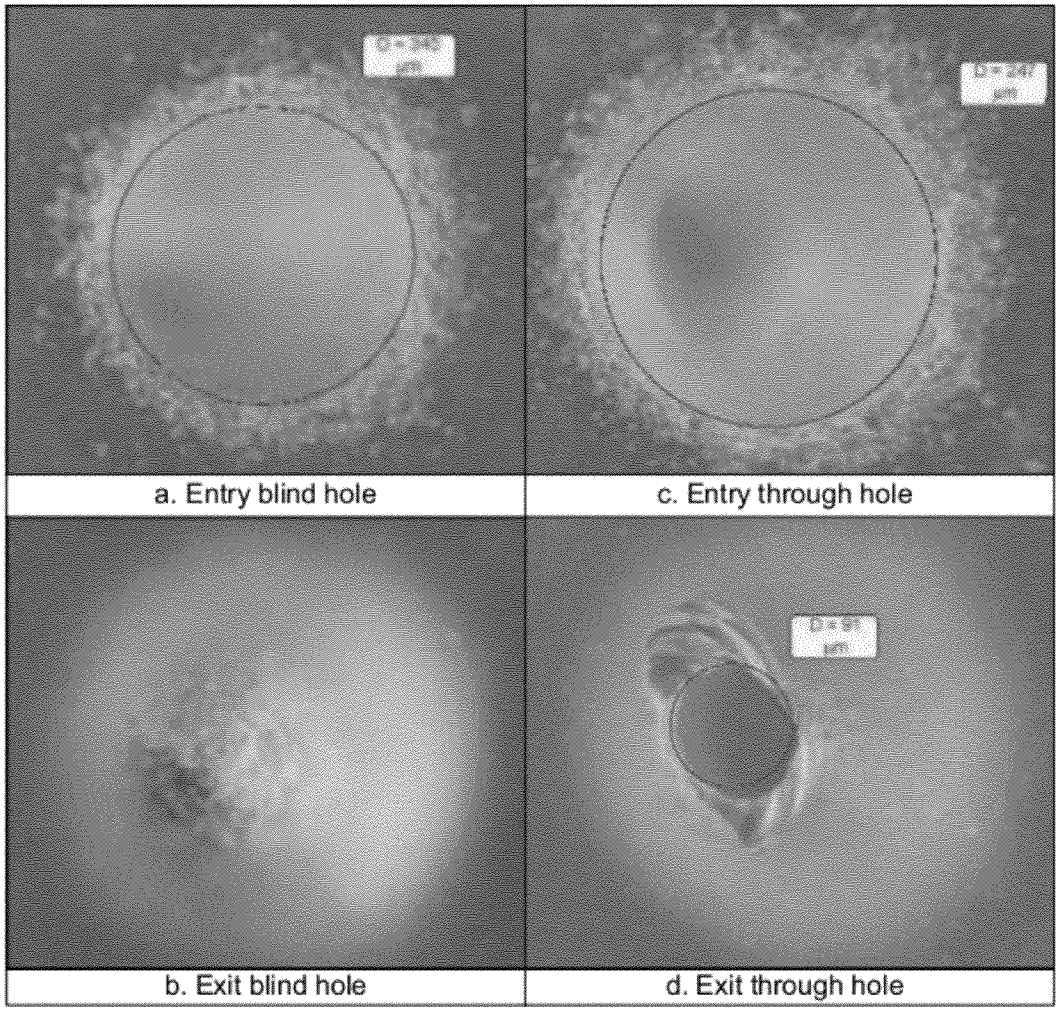
Figure 5E:
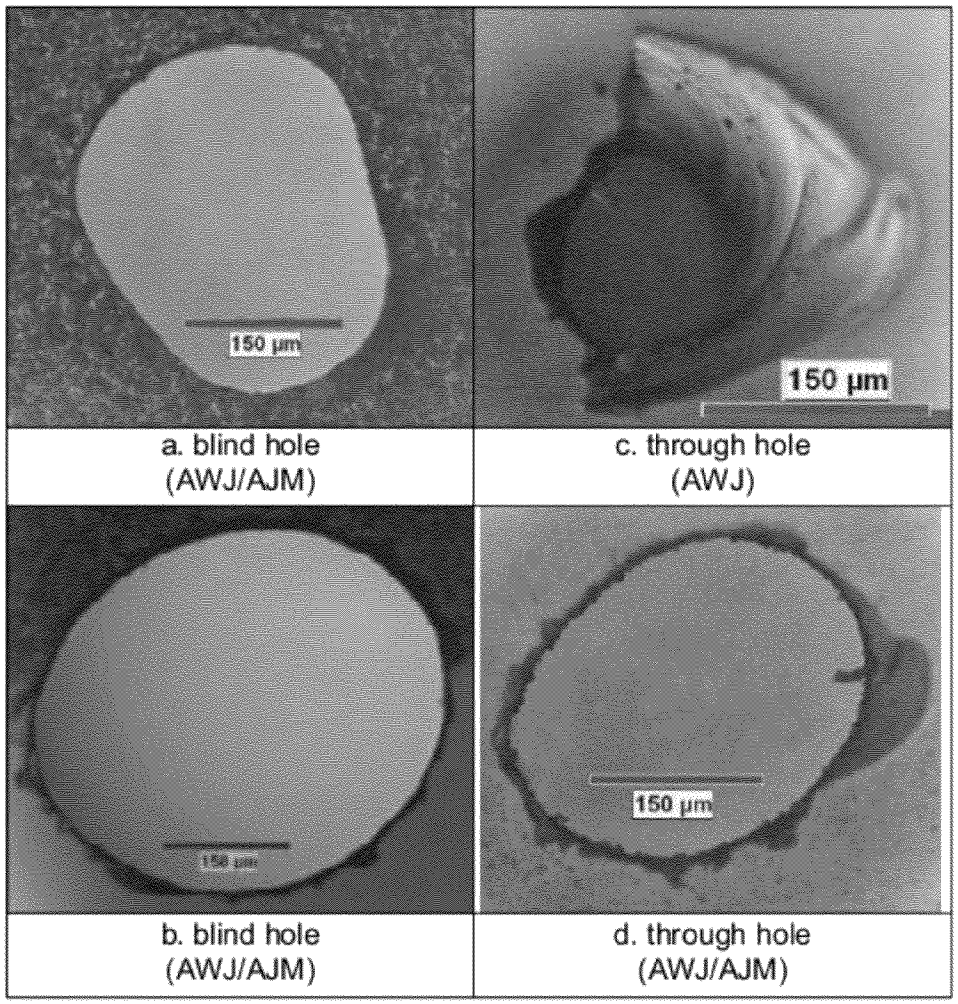

Processing a workpiece by initially piercing the workpiece with an abrasive waterjet followed by forming the through hole with an abrasive jet provides several advantages. One advantage, for example, is that these embodiments can reduce processing time as well as chipping, cracking, delamination, etc. of the workpiece. For example, initially forming the blind hole with an abrasive waterjet can take advantage of the faster material removal rates typically associated with abrasive waterjets. Completing the through hole with an abrasive jet, however, can reduce chipping, cracking, delamination, etc. of the workpiece at the exit side of the workpiece. More specifically, FIG. 5D depicts blind and through holes on Pyrex glass wafers 0.6 mm thick pierced using conventional abrasive waterjet techniques. Delamination and chipping can be seen on the exit side of the through holes. FIG. 5E depicts results from piercing materials using an abrasive waterjet technique or other liquid based working fluid abrasive jet to form a blind hole followed by using a secondary process of abrasivejet micromachining ("AJM") configured in accordance with an embodiment of the disclosure using a dry-grit microblaster in which air (or another suitable gas) is used as a working fluid instead of water or another liquid. For the blind holes where no chipping was induced by the abrasive waterjet technique (e.g., illustrated at a. and b. in FIG. 5E), the follow-up processing with the gas based working fluid abrasive jet configured in accordance with embodiments of the disclosure induced only minimum chipping. For the through hole pierced using a abrasive waterjet technique (c.), very little additional chipping was induced after the follow-up piercing using the piercing device (d.) configured in accordance with embodiments of the disclosure to trim and enlarge the hole.

Cutting Devices for Abrasive Waterjet Systems

Figure 6:
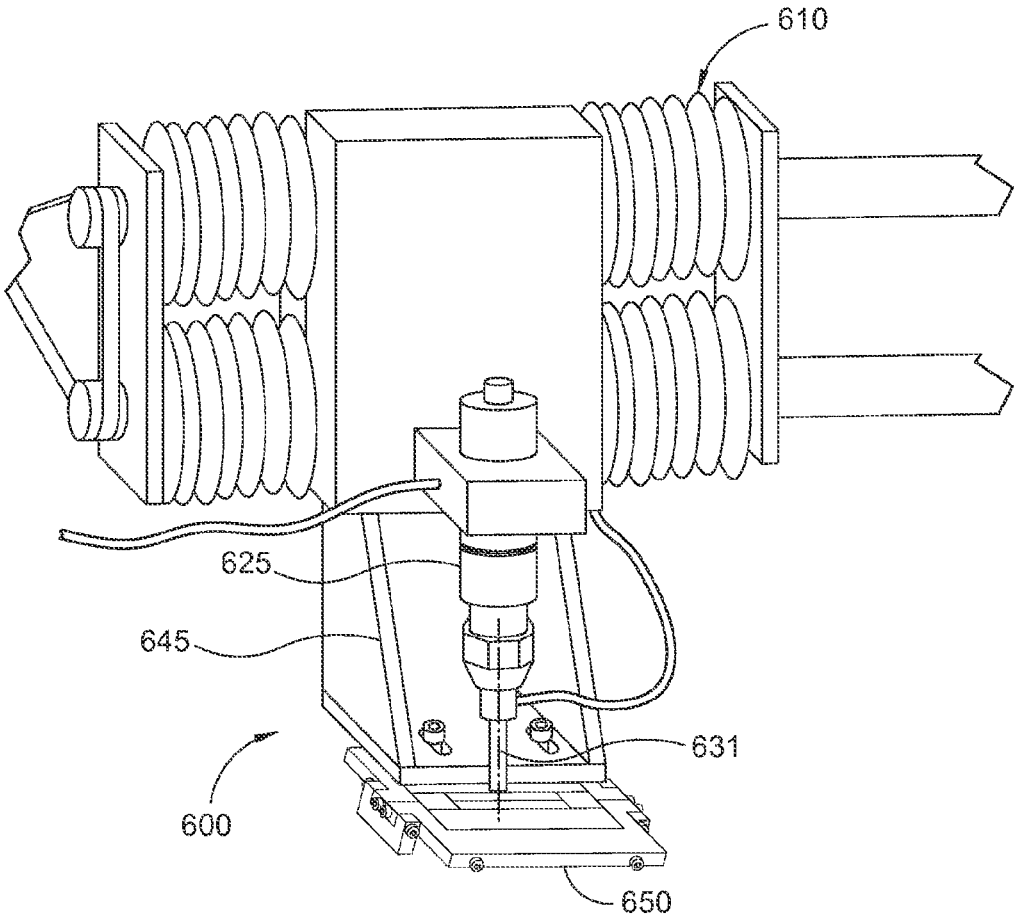
FIG. 6 is an isometric view of a portion of an abrasive waterjet system configured in accordance with an embodiment of the disclosure.

FIG. 6 is an isometric view of a portion 600 of an abrasive waterjet system configured in accordance with an embodiment of the disclosure. The portion 600 includes a traverse mechanism 610, a nozzle assembly 625 having a first iet passage with a longitudinal axis 631, a stencil holding device 645, and a cutting device 650, also referred to as a stencil 650. The stencil 650 is coupled to the stencil holding device 645. The nozzle assembly 625 is coupled to the traverse mechanism 610 so as to allow the nozzle assembly 625 to move with respect to both the stencil 650 and a workpiece that can be positioned directly below the stencil 650. The traverse mechanism 610 and the stencil holding device 645 can be coupled to a mechanism of an abrasive waterjet system that provides for movement in the X and Y directions. Such a mechanism is described with reference to, for example, FIG. 11.

Figure 7:
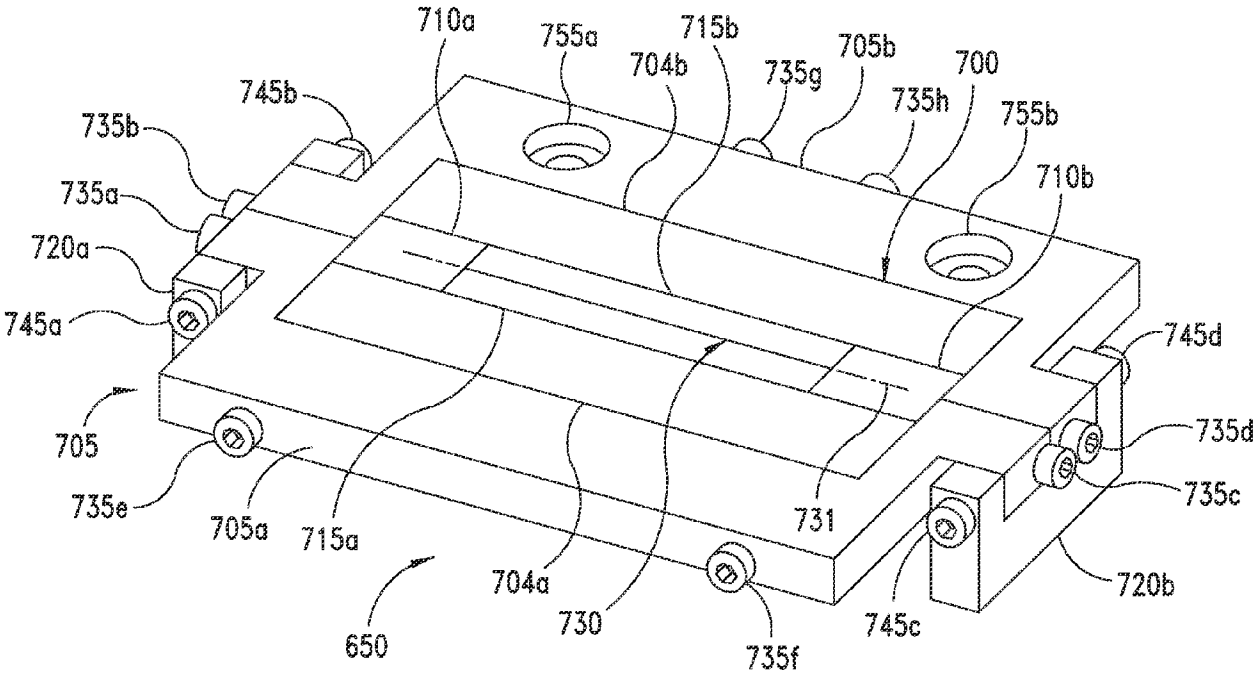
FIG. 7 is an isometric view of a cutting device configured in accordance with an embodiment of the disclosure.

FIG. 7 is an isometric view of the stencil 650 of FIG. 6. As shown in FIG. 7, the stencil 650 includes a slot portion 700 and a frame 705 surrounding the slot portion 700. The slot portion 700 includes two slot-forming plates 715 (shown individually as slot-forming plates 715*a* and 715*b*), two end plates 710 (shown individually as end plates 710*a* and 710*b*), and two side plates 704 (shown individually as side plates 704*a* and 704*b*). The first slot-forming plate 715*a*is spaced apart from the second slot-forming plate 715*b* in such a fashion as to form a passage or slot 730 between the two slot-forming plates 715. The slot 730 can have a longitudinal axis 731 extending perpendicular to the longitudinal axis 631 of the nozzle assembly 625 (FIG. 6).

The frame 705 includes a first frame portion 705*a* and a second frame portion 705*b*. The stencil 650 also includes two clamps 720 (shown individually as clamps 720*a* and 720*b*). The clamps 720 hold the two frame portions 705 together via fasteners 745 (shown individually as fasteners 745*a-d*), which can be, for example, set screws that hold the clamps 720 relative to the frame 705. The frame 705 can be fastened to the slot portion 700 by fasteners 735 (shown individually as fasteners 735*a-h*), which can be, for example, set screws that hold the frame 705 relative to the slot portion 700. Additionally or alternatively, the frame 705 can include structure (e.g., one or more ledges) configured to vertically support the slot portion 700. The frame portion 705*b* includes two apertures 755 (shown individually as apertures 755*a* and 755*b*) that enable the stencil 650 to be coupled to the stencil holding device 645 by, for example, suitable fasteners.

The two slot-forming plates 715, as well as the two end plates 710, can be formed of any suitable material known in the art (e.g., tungsten carbide and/or binderless composite carbide materials, high-grade carbides, chemical vapor deposition (CVD) diamond material, etc.). The two side plates 704, the two frame portions 705, and the two clamps 720 can be made of any suitable material known in the art (e.g., aluminum, stainless steel, etc.) The slot portion 700 can be formed by, for example, placing one or more shims between the first and second slot-forming plates 715 and then fastening (e.g., by a suitable adhesive) the slot-forming plates 715, the end plates 710, and the side plates 704 together. The shims can then be removed from between the two slot-forming plates 715 to form the slot 730. Accordingly, the thickness of the shims can determine the width of the passage or slot 730.

In operation, the stencil 650 is positioned directly above a workpiece in which one or more slots are to be cut. The thickness of a slot to be cut is determined by (based upon) the width of the slot 730. The nozzle assembly 625 can be positioned at a first end of the slot 730 and can produce an abrasive waterjet that is directed at the first end of the slot 730. The nozzle assembly 625 can be moved by the traverse mechanism 610 along the length of the slot 730 to a second end of the slot 730. During the traverse, the abrasive waterjet passes through the slot 730. The kerf width of the slot machined on the workpiece is typically confined by or constrained by the width of the slot 730. The nozzle assembly 625 can make one or more passes along the slot 730 so as to partially or completely cut through the workpiece. The length of the slot 730 can be changed in accordance with the length of the two slot-forming plates 715 or by the length of the traverse. The nozzle assembly 625, the stencil holding device 645, and the stencil 650 can then be moved to another portion of the workpiece so as to partially or completely cut additional slots.

Although the stencil 650 is illustrated as forming a linear slot 730, the stencil 650 can use slot-forming plates 715 having different configurations so as to form slots 730 of different geometries (e.g., curvilinear slots). Accordingly, the stencil 650 is not limited to linear slots 730. As an example of a modification to the stencil 650, the stencil 650 can include structure to form multiple slots. As an example of another modification, instead of using shims to determine the width of the slot 730, the two frame portions 705 can be spaced apart and the two slot-forming plates 715 can be attached to the two frame portions 705 in such a way as to form the slot 730. As another example, the stencil 650 can include slots configured in various types of patterns so as to form corresponding slots in the workpiece. Those of skill in the art will understand that various ways of forming a slot 730 can be used and that such techniques are intended to fall within the scope of this disclosure.

Figure 8:
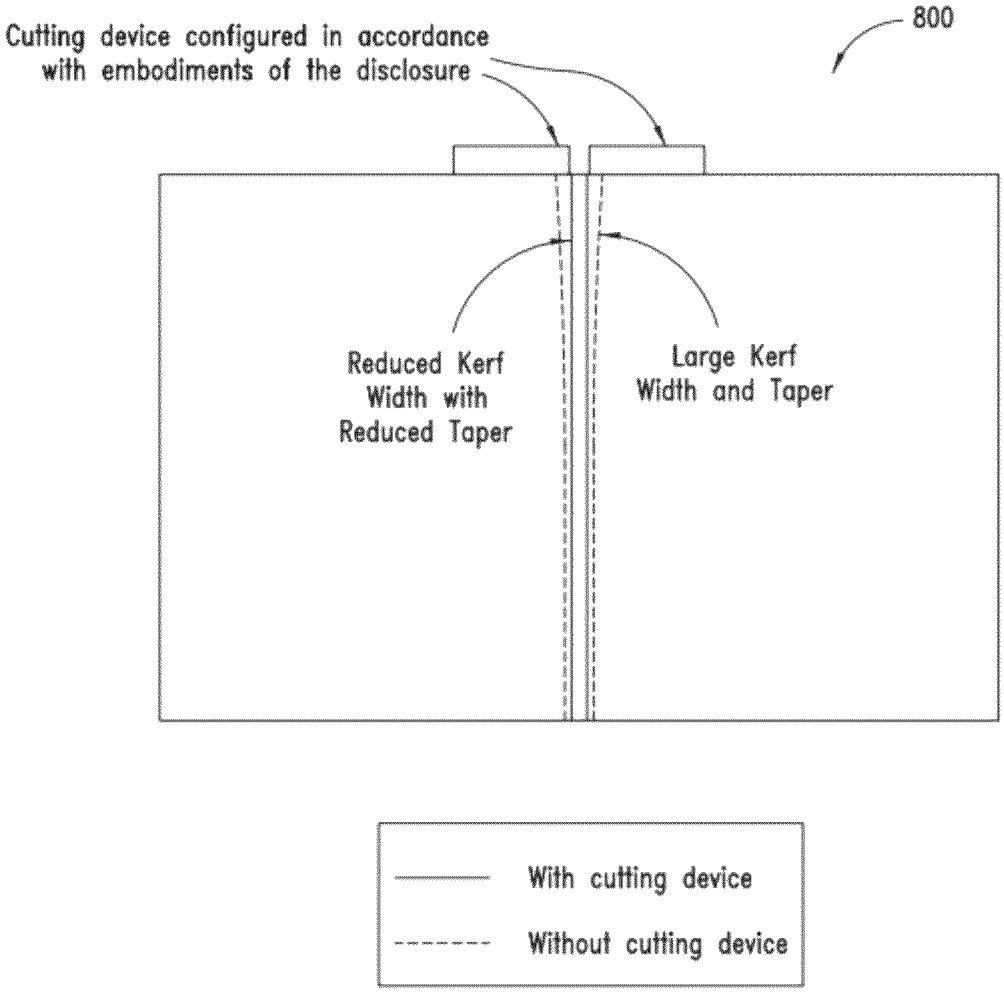
FIG. 8 is a schematic diagram illustrating an expected result from a cutting operation performed in accordance with an embodiment of the disclosure in comparison with an expected result from a conventional cutting operation.

FIG. 8 is a schematic diagram 800 illustrating an expected result from a cutting operation performed with a cutting device configured generally similarly to the stencil 650 (referred to as SAWS in the figure) in comparison with an expected result from a conventional cutting operation performed without such a cutting device. As can be seen in FIG. 8, the cut shown in solid lines represents a cut formed using a cutting device configured in accordance with embodiments of the present disclosure. The cut shown in broken lines represents a cut formed using conventional techniques without a cutting device as disclosed herein. As shown in FIG. 8, the cut shown in solid lines and formed using a cutting device is expected to have a reduced kerf width and a reduced taper in comparison to the kerf width and taper of the cut shown in broken lines formed without using such a cutting device.

Figure 9:
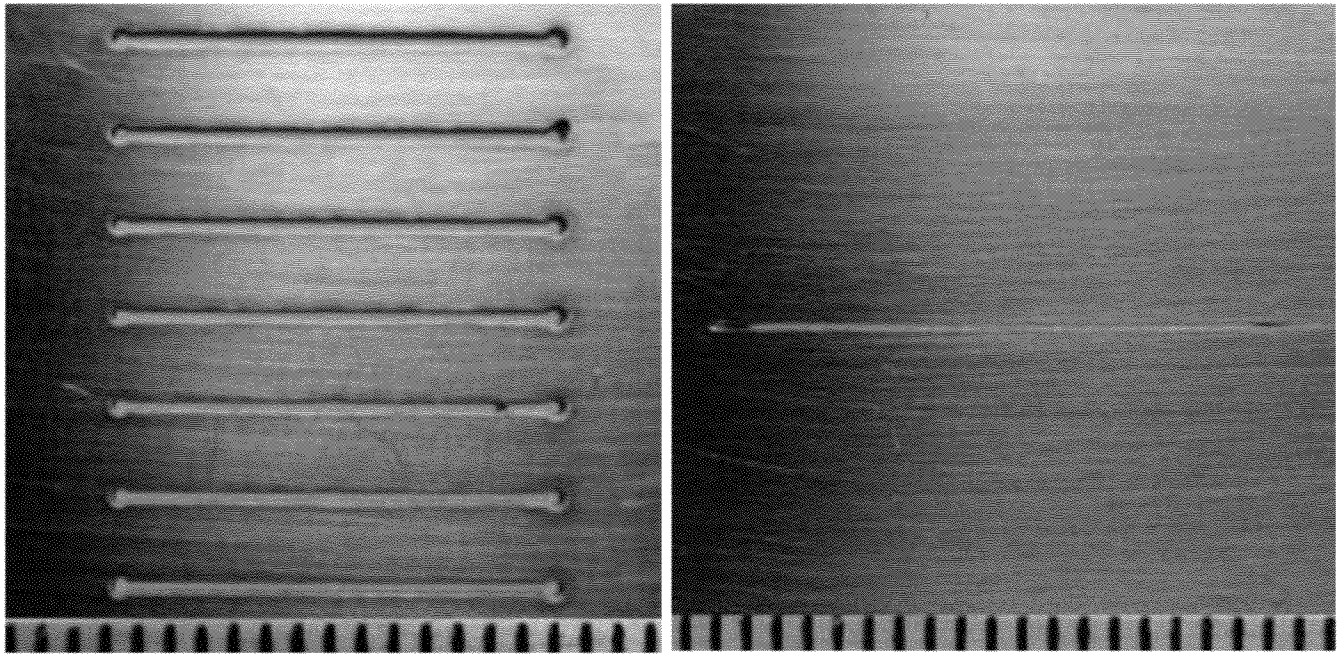
FIGS. 9 and 10 are graphical depictions of slots cut in various materials with embodiments of cutting and/or piercing devices configured in accordance with the present disclosure in comparison with a conventional slot cutting techniques.

FIG. 9 depicts a slot cut in 0.02 inch (0.5mm) thick stainless steel using a cutting device configured generally similarly to the stencil 650 described above (b.) and slots cut in 0.02 inch (0.5 mm) thick stainless steel without using such a cutting device (a.). The slots illustrated in FIG. 9 were cut using a nozzle assembly having an orifice with an inside diameter of 0.007 inch (0.18 mm) and a mixing tube having an inside diameter of 0.015 inch (0.38 mm). The abrasive waterjet cutting machine was operating at 50 ksi (348 MPa) and 220 mesh garnet was used as the abrasive. The cutting device had a slot width of 0.005 inch (0.127 mm) thick. The abrasive waterjet system cut the slots by making one pass along the slot. The traverse speed of the abrasive waterjet system used to machine the slots in (a.) was 21 inch/min (533 mm/min), whereas the traverse speed of the abrasive waterjet system used to machine the slot in (b.) was 2.4 inch/min (61 mm/min).

As can be seen in FIG. 9, there are differences in the slots machined with the two methods. The kerf widths of the slots machined without the use of the cutting device (a.) are wider than the kerf width of the slot machined with the cutting device (b.). The end points of the slots machined without the cutting device (a.) are generally larger than the average width of the slots. The enlargement at the end points typically depends on the dwell time of the abrasive waterjet system at the end points. The slot in (b.) was not cut through at the two end points. Increase in the dwell time of the abrasive waterjet at the start and stop of machining would ensure that the end points would be cut through. Since the width of the abrasive waterjet impacting the workpiece is limited by the width of the slit on the cutting device, longer dwell time would typically lead to little or no enlargement of the end points, as long as the cutting device is placed directly on top of the workpiece without a gap (or with a small gap) between the cutting device and the workpiece.

Figure 10:
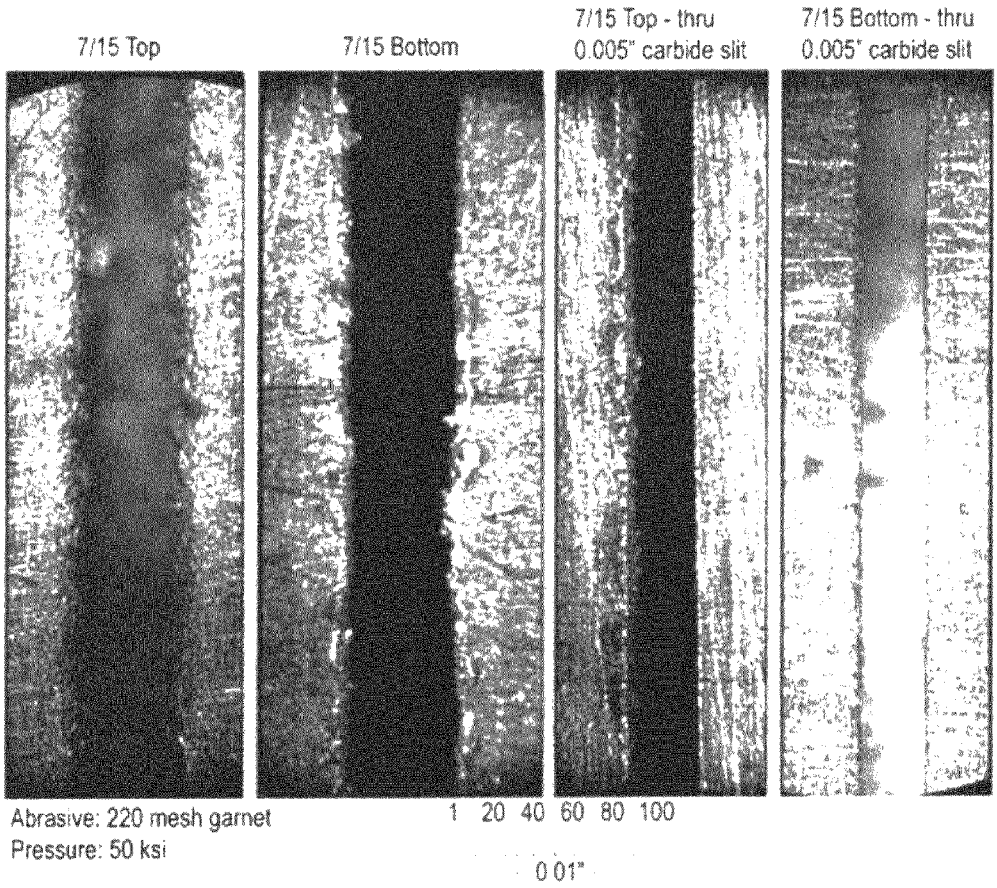

FIG. 10 illustrates 40× micrographs of two slots machined without a cutting device configured generally similarly to the stencil 650 (e.g., illustrated on the left side of FIG. 10) and with a cutting device configured generally similarly to the stencil 650, respectively (e.g., illustrated on the right side of FIG. 10). The average widths of the two slots machined without and with the cutting device were measured to be about 0.011 inch (0.280 mm) and 0.008 inch (0.200 mm), respectively. In some configurations, a slot width as small as 0.004 inch (0.100 mm) can be cut, and even smaller slot widths may be possible. As can be seen in FIG. 10, the edges of the slot machined with the cutting device and shown on the right side of FIG. 10 are generally straighter and show improved surface quality than the edges of the slot shown on the left side of FIG. 10 and machined without the cutting device. The slot shown on the right side in FIG. 10 formed by the cutting device was formed by placing the cutting device directly on top of the workpiece, without a gap (or with a small gap) between the cutting device and the workpiece. Without wishing to be bound by any particular theory, it is believed that the parallel edges of the slot guide and confine abrasives, thereby forcing the abrasives to move straight through the passage formed by the slot to the workpiece. In the absence of the cutting device, the abrasive waterjet exiting the mixing tube begins to spread outward. The average half angle of the spread is believed to be about 6 degrees. The velocity of the abrasives acquires a radially outward component as the abrasives travel through a gap between the outlet of the mixing tube and the surface of the workpiece. It is believed that the radially outward component and/or the dwell time is/are responsible for enlarging the end points of slots.

One of the advantages using a cutting device configured generally similarly to the stencil 650 as described herein is that there is a reduced need to use an abrasive waterjet nozzle assembly with a small orifice and mixing tube inside diameter combination. Such a configuration can lead to clogging of the nozzle assembly and/or unsteady feed of abrasives resulting in inconsistent cutting or skip cutting. The stencil 650 allows use of an abrasive waterjet nozzle assembly with a standard sized orifice and mixing tube inside diameter combination. Accordingly, the use of the stencil 650 can mitigate or reduce the problem of the nozzle assembly clogging and the problem of inconsistent cutting or skip cutting due to unsteady feed of abrasives. Moreover, using a nozzle assembly that produces an abrasive waterjet with a large jet diameter can ease the requirement for precision alignment of the nozzle assembly with respect to the stencil 615. As long as a core or a suitable amount of the abrasive waterjet covers the slot 730 over the length of the slot to be cut, the alignment of the nozzle assembly with respect to the stencil 650 can be less precise than the alignment required when not using the stencil 650. Another advantage provided by the stencil 650 is the ability to cut thicker materials while maintaining a generally constant kerf width.

Another advantage would involve using a stencil 650 to cut slots in certain materials, such as soft materials or thin metal shims, using a waterjet (without abrasives). For waterjet cutting, the erosion mode is typically via shear and tear, which can result in frayed edges. Stencil-aided machining can minimize fraying by machining the workpiece at a slower speed. In this case, the stencil would have exactly the same pattern as the machined part. A smaller jet offset can be used when cutting the workpiece such that the center of the waterjet would be lined up with the edges of the stencil. In the presence of the stencil 650, the traversing speed of the waterjet can slow down without increasing the kerf width. The waterjet can perform both cutting and cleaning as it passes along the stencil 650. Moreover, the operating life of the stencil may increase if abrasives are not used.

Illustrative Abrasive Waterjet System

Figure 11:
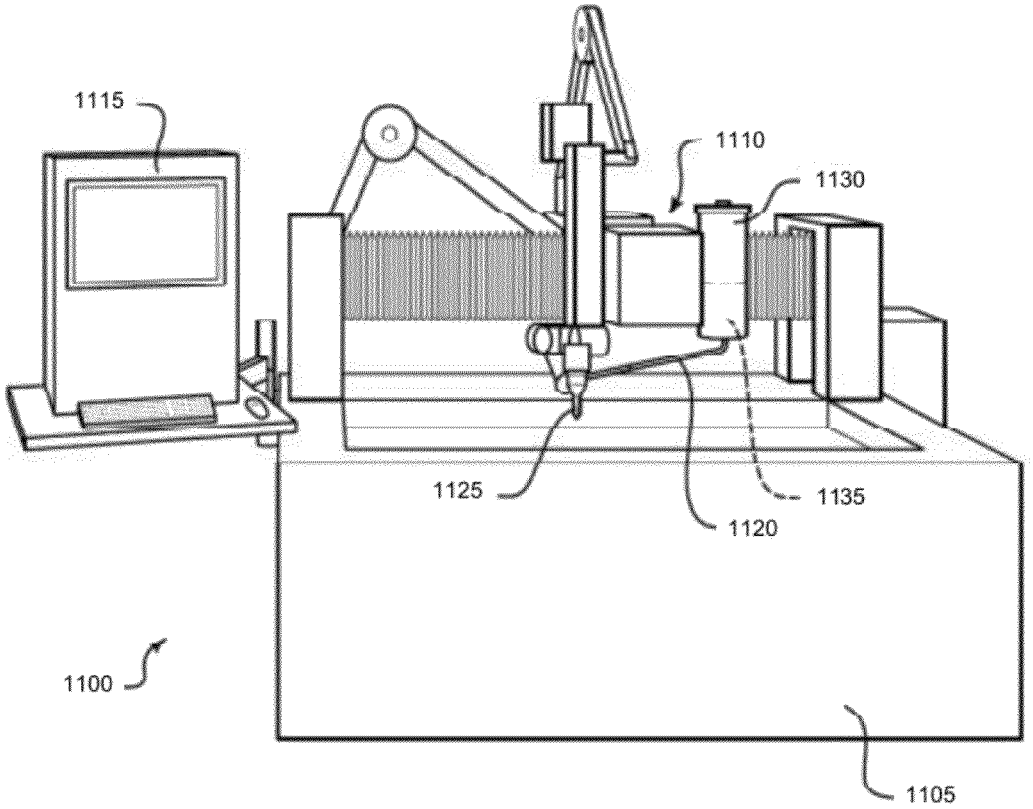
FIG. 11 is an isometric view of an abrasive waterjet system with which cutting and/or piercing devices configured in accordance with embodiments of the disclosure can be utilized.

FIG. 11 is an isometric view of an abrasive waterjet system 1100 with which piercing and/or cutting devices configured in accordance with embodiments of the disclosure can be utilized. The abrasive waterjet system 1100 includes a base 1105 and a mechanism 1110 for moving a nozzle assembly 1125 (which the piercing apparatus forms a part of) in both the X and Y directions. The abrasive jet system 1100 may also include a pressurized water source, such as a pump (not shown in FIG. 11) that conveys highly pressurized water (e.g., water at a high pressure, such as about 15,000 psi to about 60,000 psi or more) to the nozzle assembly 1125. The abrasive jet system 1100 also includes an abrasive container 1130 and an abrasive supply conduit 1120 that conveys abrasives 1135 from the abrasive container 1130 to the nozzle assembly 1125. The abrasive jet system 1100 can also include a controller 1115 that an operator may use to program or otherwise control the abrasive jet system 1100.

Illustrative Piercing and/or Cutting Method

Figure 12:
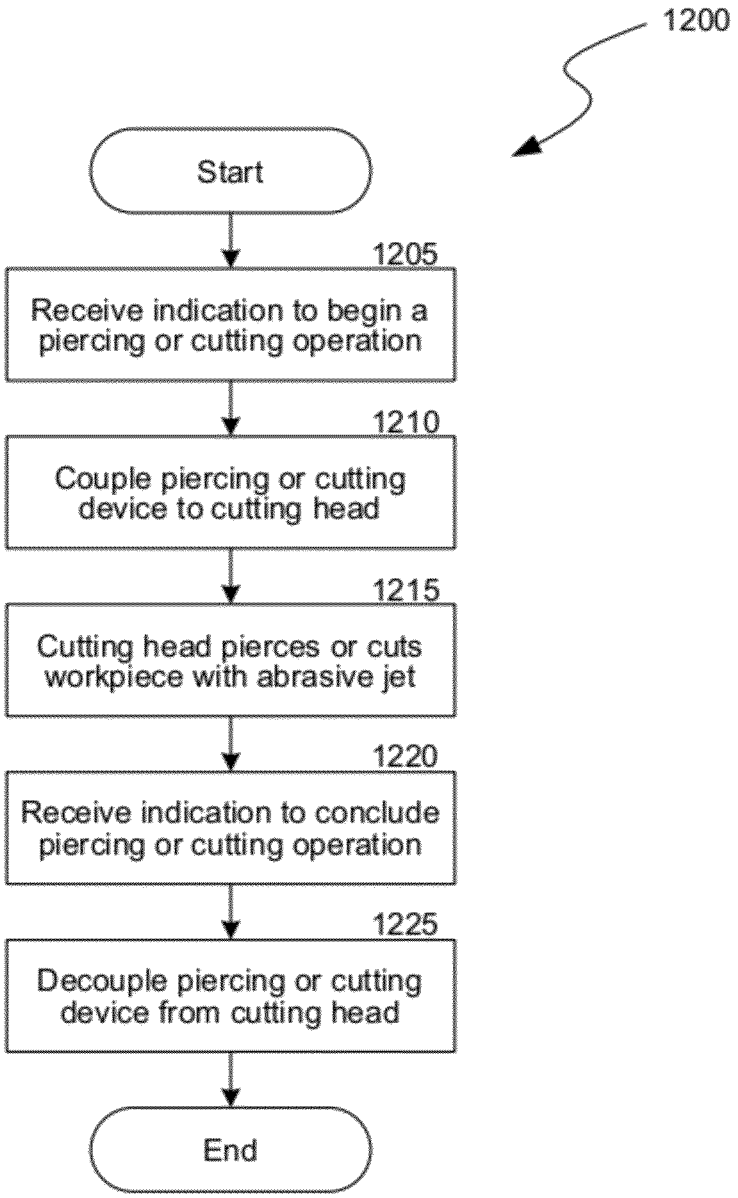
FIG. 12 is a flow diagram of a process for performing a piercing or cutting operation in accordance with an embodiment of the disclosure.

FIG. 12 is a flow diagram of a process 1200 for performing a piercing or cutting operation with an abrasive waterjet system utilizing a piercing or cutting device configured in accordance with some embodiments of the disclosure. The process 1200 begins at step 1205, where the abrasive waterjet system receives an indication to begin an operation to pierce or cut a workpiece. The indication may be received from an operator of the abrasive waterjet system or from control software of a controller (e.g., the controller 515 of the abrasive waterjet system 500). At step 1210 the piercing or cutting device is coupled to the abrasive waterjet system. For example, a piercing device such as the piercing devices illustrated in FIGS. 1A to 4B can be coupled to the nozzle assembly of the abrasive waterjet system. As another example, the cutting device 650 illustrated in FIGS. 6 and 7 can be coupled to a suitable component of the abrasive waterjet system.

At step 1215, the abrasive waterjet system directs the abrasive waterjet against a surface of the workpiece to pierce or cut the workpiece. At step 1220, the abrasive waterjet system receives an indication to conclude the piercing or cutting operation, such as from an operator of the abrasive waterjet system or from control software of the controller of the abrasive waterjet system. For example, the controller can receive an indication, such as from a component that actively detects that the piercing or cutting operation has completed, of the completion of the piercing or cutting operation. As another example, the controller can cause the piercing or cutting operation to conclude after a predetermined period of time that is based upon various factors such as the thickness of the workpiece, a dwell time, and/or other factors. At step 1225 the piercing or cutting device is removed from the abrasive waterjet system. After step 1225, the process 1200 concludes.

After performing the process 1200, the abrasive waterjet system can perform other operations. For example, after piercing a hole in a workpiece, the abrasive waterjet system can begin cutting at the location of the hole pierced through the workpiece. Additionally or alternatively, the abrasive waterjet system can repeat the process 1200 one or more times to pierce or cut the workpiece one or more times (for example, to make multiple holes or multiple slots in the workpiece). After performing piercing operations, the abrasive waterjet system can perform cutting operations, and after performing cutting operations, the abrasive waterjet system can perform piercing operations. Those of skill in the art will understand that there are multiple ways in which an abrasive waterjet system can vary sequences of piercing and cutting operations.

Those skilled in the art will appreciate that the steps shown in FIG. 12 may be altered in a variety of ways without departing from the spirit or scope of the present disclosure. For example, the order of the steps may be rearranged; substeps may be performed in parallel; shown steps may be omitted, or other steps may be included; etc.

Conclusion

From the foregoing, it will be appreciated that specific embodiments have been described herein for purposes of illustration, but that various modifications may be made without deviating from the spirit and scope. Those skilled in the art will recognize that numerous liquids other than water can be used, and the recitation of a jet as including water should not necessarily be interpreted as a limitation. For example, fluids other than water can also be employed to cut materials that cannot be in contact with water. A customary term for the process of cutting with a fluid is "waterjet cutting" and the like, but the term "waterjet cutting" is not intended to exclude cutting by jets of fluid other than water or cutting by jets of fluid mixed with abrasives.

As an example of a modification, an abrasive waterjet system may be equipped with both a piercing device (e.g., for performing piercing operations) and a cutting device (e.g., for performing cutting operations). In such a modification, the abrasive waterjet system may perform piercing operations and cutting operations simultaneously or consecutively. As another example, a waterjet system (e.g., a system that does not use abrasives) may utilize embodiments of the piercing device described herein to perform piercing and/or cutting operations without using abrasives. As another example, instead of moving a stencil and a nozzle assembly with respect to a workpiece, the workpiece can be moved (e.g., in the X and/or Y directions and/or rotated) with respect to the stencil and the nozzle assembly. In another example, an abrasive waterjet may be modified so that the cutting nozzle may be transformed into the piercing device by various devices or assemblies such as moving a secondary passage in front of the cutting nozzle during piercing or forming the cutting nozzle out of a plurality of sections such that the sections are co-aligned and fitted together axially during cutting and are then separated to allow a gap to be formed therebetween creating the basis of the piercing device during a piercing operation.

While advantages associated with certain embodiments have been described in the context of those embodiments, other embodiments may also exhibit such advantages, and not all embodiments need necessarily exhibit such advantages to fall within the scope of the present disclosure. Moreover, the embodiments described may exhibit advantages other than those described herein. Accordingly, the disclosure is not limited except as by the appended claims.

We claim:

1. An abrasive jet system configured to remove at least a portion of a target material with an abrasive waterjet, the abrasive jet system comprising:

a piercing device having a mixing tube having a first axial passage through which the abrasive waterjet travels, the abrasive waterjet including pressurized water and abrasives;

a secondary tube having a second axial passage through which the abrasive waterjet travels, wherein the second axial passage is axially aligned with the first axial passage;

an exit for the abrasive waterjet;

a holding device positioning the mixing tube relative to the secondary tube;

an opening in an outer surface of the holding device; and an air passage extending from the opening through at least a portion of the holding device to a location generally positioned between an outlet of the mixing tube and an inlet of the secondary tube, wherein the location is upstream of the exit and downstream of any mixing region in which the abrasive waterjet is formed by mixing the pressurized water with the abrasives, wherein the air passage is configured to allow air entering through the opening to flow into the abrasive waterjet.

2. The abrasive jet system of claim 1 wherein the first axial passage is a first cylindrical axial passage and the second axial passage is a second cylindrical axial passage; and wherein the exit is at a distal end portion of the secondary tube.

3. The abrasive jet system of claim 1 wherein the first and second axial passages are cylindrical, and wherein the holding device has an inner diameter that is generally the same as outer diameters of the mixing tube and the secondary tube.

4. The abrasive jet system of claim 1 wherein the opening is a first opening and the air passage is a first air passage, and wherein the piercing device further comprises a second opening in the outer surface and a second air passage extending from the second opening to the location generally positioned between the outlet of the mixing tube and the inlet of the secondary tube, wherein the second passage is configured to allow air entering through the second opening to flow into the abrasive waterjet.

5. The abrasive jet system of claim 4 wherein at least one of the first and second passages extends at a non-perpendicular angle with reference to the axial passage.

6. An abrasive jet system configured to remove at least a portion of a target material with an abrasive jet, the abrasive jet system comprising:

a piercing device having an outer surface;

a mixing tube;

a first axial passage extending through at least a portion of the mixing tube, wherein the first axial passage has a first diameter;

a secondary tube proximate to the mixing tube;

a second axial passage extending through at least a portion of the secondary tube, wherein the second axial passage has a second diameter less than the first diameter, wherein the first and second axial passages together define an axial passage through which the abrasive jet travels;

an exit for the abrasive jet;

an opening in the outer surface;

an air passage extending from the opening to an intermediate portion of the axial passage downstream of any mixing region in which the abrasive jet is formed and upstream of the exit, wherein the air passage is configured to allow air entering through the opening to flow into the abrasive jet.

7. The abrasive jet system of claim 6 wherein:

the mixing tube has an outlet; and the secondary tube has an inlet opposite an outlet, wherein the secondary tube inlet is spaced apart from the mixing tube outlet, and wherein the exit is at the secondary tube outlet.

8. The abrasive jet system of claim 6 wherein the mixing tube includes the outer surface.

9. A jet system for processing a material, the jet system comprising:

a nozzle assembly having a piercing device including a first jet passage through which an abrasive jet moves; and a secondary device, spaced apart from the piercing device, having a second jet passage through at least a portion of which the jet moves, wherein the first jet passage has a first longitudinal axis and the second jet passage has a second longitudinal axis, and wherein the secondary device includes a first plate spaced apart from a second plate, and wherein the second jet passage is a slot at least partially defined between the first and second plates.

10. The jet system of claim 9 wherein the slot has a constant width and parallel edges.

11. The jet system of claim 9 wherein the slot is curvilinear.

12. The jet system of claim 9 wherein the secondary device is configured to directly contact the material.

13. A jet system for processing a material, the jet system comprising:

a nozzle assembly having a piercing device including a first jet passage through which an abrasive jet moves; and a secondary device, spaced apart from the piercing device, having a second jet passage through at least a portion of which the jet moves, wherein the secondary device includes:

a frame;

a first side plate coupled to the frame;

a second side plate coupled to the frame opposite the first side plate;

a first passage forming plate adjacent to the first side plate; and a second passage forming plate adjacent to the second side plate and spaced apart from the first passage forming plate to at least partially define the second jet passage therebetween.

14. The jet system of claim 13 wherein the first passage forming plate is adjustable relative to the second passage forming plate to change a width of the second jet passage.

15. A method of operating an abrasive jet system, the method comprising:

forming an abrasive jet comprising pressurized water and abrasives;

directing the abrasive jet through a first passage and an outlet in a mixing tube;

directing the abrasive jet through an inlet and a second passage in a secondary tube, wherein the inlet of the secondary tube is spaced apart from the outlet of the mixing tube;

allowing air from an air passage downstream of the mixing tube outlet and upstream of the secondary tube inlet to mix with the abrasive jet; and directing the abrasive jet against a workpiece.

16. The method of claim 15 wherein:

forming an abrasive jet comprises combining the pressurized water with the abrasives in a mixing region of the abrasive jet system; and allowing air from the air passage to mix with the abrasive jet comprises allowing air to flow into the abrasive jet from the air passage downstream of the mixing region.

17. The method of claim 15 wherein:

forming the abrasive jet comprises forming the abrasive jet in a nozzle assembly having the mixing tube; and directing the abrasive jet against the workpiece comprises directing the abrasive jet from the secondary tube spaced apart from the mixing tube.

18. The method of claim 17 wherein at least a portion of the air passage is formed in a holding device positioning the mixing tube relative to the secondary tube, and wherein allowing air from the air passage to mix with the abrasive jet comprises allowing air to flow through the holding device to mix with the abrasive jet at a location between the mixing tube and the secondary tube.

19. The method of claim 15 wherein:

forming the abrasive jet comprises forming the abrasive jet in an axial passage of a nozzle assembly, wherein the axial passage extends in a direction generally parallel to a longitudinal axis of the nozzle assembly; and allowing air from the air passage to mix with the abrasive jet comprises allowing air to mix with the abrasive jet from an air passage of the nozzle assembly, wherein the air passage extends in a directly generally non-parallel to the longitudinal axis of the nozzle assembly.

20. A method of operating an abrasive jet system, the method comprising:

forming an abrasive jet;

directing the abrasive jet through a first passage formed by a first device;

allowing air to pass through an opening in the abrasive jet system and contact the abrasive jet prior to directing the abrasive jet through a second passage;

directing the abrasive jet through the second passage, wherein the second passage is formed by a second device spaced from the first device, wherein directing the jet through the second passage includes directing the jet through a slot having a constant width; and directing the jet against a workpiece.

21. The method of claim 20 wherein forming the abrasive jet comprises forming the abrasive jet in a mixing region of the first device, wherein the mixing region is upstream from the first and second passages.

22. A method of operating an abrasive jet system, the method comprising:

forming an abrasive jet ;

directing the abrasive jet through a first passage formed by a first device;

directing the abrasive jet through a second passage formed by a second device spaced apart from the first device, wherein directing the jet through the second passage includes directing the jet through a slot formed between a first plate that is spaced apart from a second plate, the slot having a constant width; and directing the jet against a workpiece.

23. The method of claim 22 wherein directing the jet against the workpiece comprises directing the jet from the second device spaced apart from the workpiece.

24. The method of claim 22 wherein directing the jet against the workpiece comprises directing the jet from the second device while the second device directly contacts at least a portion of the workpiece.

25. A method of operating an abrasive jet system, the method comprising:

forming a first abrasive jet including a liquid working fluid combined with abrasive;

directing the first abrasive jet toward a workpiece to form an opening in the workpiece, the opening extending a depth into the workpiece from a first side of the workpiece, wherein the depth is less than a thickness of the workpiece;

forming a second abrasive jet including a gas working fluid combined with abrasive; and directing the second abrasive jet toward the opening in the workpiece to extend the opening through a second side of the workpiece opposite the first side.

26. The method of claim 25 wherein directing the first abrasive jet toward the workpiece comprises:

directing the first abrasive jet through a first passage formed by a first device in a nozzle assembly; and directing the first abrasive jet through a second passage formed by a second device spaced apart from the first device.

27. The method of claim 26 wherein directing the first abrasive jet through the second passage comprises directing the first abrasive jet through a second device spaced apart from the workpiece.

28. The method of claim 26 wherein directing the first abrasive jet through the second passage comprises directing the first abrasive jet through a second device that directly contacts the workpiece.

29. The method of claim 25 wherein:

directing the first abrasive jet toward the workpiece comprises directing the first abrasive jet toward the workpiece to form the opening having a cross-sectional dimension; and directing the second abrasive jet toward the opening comprises changing the cross-sectional dimension of the opening.

30. The method of claim 25 wherein:

directing the first abrasive jet toward the workpiece to form the opening in the workpiece comprises removing material from the workpiece at a first rate; and directing the second abrasive jet toward the opening in the workpiece to extend the opening through the second side of the workpiece comprises removing material from the workpiece at a second rate that is less than the first rate.

* * * * *